US009941615B2

(12) United States Patent
Saito et al.

(10) Patent No.: US 9,941,615 B2
(45) Date of Patent: Apr. 10, 2018

(54) TERMINAL AND CONNECTOR

(71) Applicant: Yazaki Corporation, Tokyo (JP)

(72) Inventors: Atsuhito Saito, Makinohara (JP); Kentaro Nagai, Makinohara (JP); Akira Shinchi, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 15/227,153

(22) Filed: Aug. 3, 2016

(65) Prior Publication Data

US 2017/0040728 A1 Feb. 9, 2017

(30) Foreign Application Priority Data

Aug. 5, 2015 (JP) ..... 2015-155142
Aug. 5, 2015 (JP) ..... 2015-155143

(51) Int. Cl.

| | |
|---|---|
| ***H01R 9/22*** | (2006.01) |
| ***H01R 13/11*** | (2006.01) |
| ***H01R 9/24*** | (2006.01) |
| ***H01R 4/18*** | (2006.01) |

(52) U.S. Cl.

CPC ..... *H01R 13/11* (2013.01); *H01R 4/185* (2013.01); *H01R 9/24* (2013.01)

(58) Field of Classification Search

CPC . H01R 13/11; H01R 9/24; H01R 4/48; H01R 13/52

USPC ..... 439/722, 842, 843, 851, 852

See application file for complete search history.

(56) References Cited

U.S. PATENT DOCUMENTS

| | | | |
|---|---|---|---|
| 5,186,664 | A | 2/1993 | Abe |
| 5,839,925 | A | 11/1998 | Simmons |
| 6,244,910 | B1 | 6/2001 | Grubbs |
| 6,790,100 | B2 | 9/2004 | Nankou et al. |
| 7,179,138 | B2 | 2/2007 | Nora et al. |

(Continued)

FOREIGN PATENT DOCUMENTS

| | | | |
|---|---|---|---|
| JP | H04368781 | A | 12/1992 |
| JP | H07326415 | A | 12/1995 |

(Continued)

OTHER PUBLICATIONS

Office Action dated Jul. 11, 2017 issued for corresponding Japanese Patent Application No. 2015-155142.

(Continued)

*Primary Examiner* — Abdullah Riyami
*Assistant Examiner* — Nader Alhawamdeh
(74) *Attorney, Agent, or Firm* — Locke Lord LLP

(57) ABSTRACT

A leaf spring portion turning back at a bottom wall (first side wall portion) and coming into contact with a male terminal of a connector on the other side to press the male terminal to a ceiling wall (second side wall portion) is formed in a tubular-shaped main terminal body portion in a terminal, the main terminal body portion is formed when a metal plate is bent in a tubular shape such that a pair of end edges approaches each other to form the ceiling wall (second side wall portion), and depressed portions bending toward an inside of the main terminal body portion and extending in a longitudinal direction of the main terminal body portion are provided in a pair of respective wall portions forming the ceiling wall (second side wall portion).

20 Claims, 16 Drawing Sheets

(56) References Cited

U.S. PATENT DOCUMENTS

| | | | | |
|---|---|---|---|---|
| 7,347,747 | B2 * | 3/2008 | Shimizu | H01R 13/11 439/842 |
| 8,241,075 | B2 | 8/2012 | Ishikawa et al. | |
| 8,900,020 | B2 * | 12/2014 | Aoki | H01R 4/183 439/851 |
| 9,490,563 | B2 * | 11/2016 | Shinmi | H01R 13/115 |
| 9,496,641 | B2 * | 11/2016 | Watanabe | H01R 13/562 |
| 2007/0111599 | A1 | 5/2007 | Tanaka | |
| 2007/0111614 | A1 | 5/2007 | Tanaka | |
| 2012/0220149 | A1 * | 8/2012 | Mizutani | H01R 13/113 439/271 |
| 2013/0040509 | A1 * | 2/2013 | Mitose | H01R 4/185 439/877 |
| 2015/0064991 | A1 * | 3/2015 | Kawamura | H01R 4/183 439/879 |
| 2015/0222038 | A1 * | 8/2015 | Volpone | H01R 13/115 439/842 |
| 2016/0079686 | A1 * | 3/2016 | Shinmi | H01R 13/115 439/842 |
| 2017/0040728 | A1 * | 2/2017 | Saito | H01R 13/11 |

FOREIGN PATENT DOCUMENTS

| | | | |
|---|---|---|---|
| JP | 2003297470 | A | 10/2003 |
| JP | 2006216316 | A | 8/2006 |
| JP | 4586714 | B2 | 11/2010 |
| JP | 4650918 | B2 | 12/2010 |
| JP | 2012038550 | A | 2/2012 |

OTHER PUBLICATIONS

Office Action dated Jul. 11, 2017 issued for corresponding Japanese Patent Application No. 2015-155143.

* cited by examiner

TERMINAL AND CONNECTOR

TECHNICAL FIELD

The present invention relates to a terminal for a connector, and a connector including the terminal.

RELATED ART

Various electronic devices are installed in a vehicle serving as a moving body. These electronic devices are connected by a wire harness to convey power, a control signal, etc. therebetween. In general, a connector is attached to a terminal of a wire harness, and a metal terminal is provided in the connector (for example, see JP 4586714 B2). The connector is connected to another connector through the terminal.

FIG. 19 is a diagram illustrating an example of a conventional terminal provided in a connector, FIG. 20 is an enlarged view of an area A701 of FIG. 19, and FIG. 21 is a cross-sectional view illustrating a V701-V701 cross section of FIG. 20 of the connector illustrated in FIG. 19.

A terminal 700 illustrated in FIG. 19 to FIG. 21 is fixed to a distal end of an electric wire 72 that forms a wire harness (not illustrated), and accommodated in a terminal housing chamber 73*a* provided in a housing 73 of a connector 7. The terminal 700 includes an electric wire fixed portion 710 fixed to the distal end of the electric wire 72, and a main terminal body portion 720 electrically connected to another connector terminal.

The terminal 700 is a female terminal to which a pin-shaped male terminal is inserted. The main terminal body portion 720 is formed in a shape of a rectangular tube such that the male terminal is inserted from an opening 721 on the opposite side from the electric wire fixed portion 710.

Herein, a lance 73*b* entering an inside of the main terminal body portion 720 of the terminal 700 from the terminal housing chamber 73*a* is provided in the terminal housing chamber 73*a* in the housing 73 of the connector 7. An approach hole 722*a* for locking the lance 73*b* is provided in a bottom wall 722 of the main terminal body portion 720. The lance 73*b* is formed to be elastically deformable. The lance 73*b* is elastically deformed to allow the main terminal body portion 720 to pass therethrough when the terminal 700 is inserted into the terminal housing chamber 73*a* of the housing 73, and the lance 73*b* is restored to enter the inside of the main terminal body portion 720 and locked when the approach hole 722*a* reaches up to a position of the lance 73*b*. When the lance 73*b* is locked, the terminal 700 is accommodated in the terminal housing chamber 73*a* in a retained state.

A leaf spring portion 723 as below is provided as a structure for electric connection with the inserted male terminal in the main terminal body portion 720. The leaf spring portion 723 is formed to extend in a band shape from an edge 722*b* of the bottom wall 722 on the opening 721 side, and turns back to the inside of the main terminal body portion 720 at the edge 722*b*.

An end portion 723*a* of the leaf spring portion 723 comes into contact with a rack 725 which is provided at a position closer to a ceiling wall 724 than from the bottom wall 722. In addition, the leaf spring portion 723 has a bent shape which is convex to the ceiling wall 724 side from the edge 722*b* of the bottom wall 722 corresponding to a start point of turning back to the end portion 723*a*. Further, the leaf spring portion 723 is elastically deformable such that a contact portion 723*b* provided at an apex portion of the bent shape moves in an approaching/separating direction D701 with respect to the bottom wall 722 while the end portion 723*a* comes into contact with the rack 725.

When the male terminal on the other side is inserted into the opening 721, the contact portion 723*b* of the leaf spring portion 723 comes into contact with the male terminal and is pushed by the male terminal, and the leaf spring portion 723 is elastically deformed such that the contact portion 723*b* approaches the bottom wall 722. The leaf spring portion 723 comes into contact with the male terminal at a contact load caused by a restoring force of elastic deformation at the contact portion 723*b*, and presses the male terminal to the ceiling wall 724 facing the bottom wall 722. The main terminal body portion 720 (that is, the terminal 700) is electrically connected to the male terminal by contact between the male terminal and the leaf spring portion 723 and contact between the male terminal and the ceiling wall 724 in a state in which the leaf spring portion 723 is pressed.

In addition, as illustrated in FIG. 21, the main terminal body portion 720 of the terminal 700 is formed by bending a metal plate in a shape of a rectangular tube, and the ceiling wall 724 is formed by overlapping both end portions 724*a* of the metal plate.

Patent Literature 1: JP 4586714 B2

SUMMARY

Herein, even though a shape of a male terminal on the other side is within a range of a fabrication tolerance, the shape may be slightly distorted. In addition, in the terminal 700 illustrated in FIG. 19 to FIG. 21, the shape of the main terminal body portion 720 corresponding to the shape of the rectangular tube may be a shape slightly distorted within a range of a fabrication tolerance. Further, the male terminal may be in an unstable position in which the male terminal is inclined inside the main terminal body portion 720 depending on distortion levels of both the shapes. When a degree of inclination is excessively large, there is a concern that electric connection between the terminal 700 and the male terminal may be insufficient. In addition, a precise shape is considered to be manufactured by suppressing a fabrication tolerance in the terminal 700 and the male terminal in order to suppress the above-described distortion, there is a concern that such manufacturing may cost a lot.

An object of the invention is to provide a terminal capable of obtaining sufficient electric connection between the terminal and a mating connector terminal while suppressing a manufacturing cost, and a connector including the terminal.

In order to solve the above issue, a terminal of the invention is a terminal made of metal including a main terminal body portion extending in a tubular shape into which a mating connector terminal is inserted from an opening at a distal end, the terminal being accommodated in a terminal housing chamber provided in a housing of a connector, wherein a leaf spring portion turning back to an inside of the main terminal body portion from an edge portion corresponding to a portion of an edge of the opening is formed in the main terminal body portion, the leaf spring portion presses the inserted mating connector terminal toward a second side wall portion facing a first side wall portion extending in a longitudinal direction of the main terminal body portion from the edge portion in a side wall of the tubular shape of the main terminal body portion while coming into contact with the mating connector terminal, the main terminal body portion is obtained when a metal plate having a pair of end edges extending in parallel with each other in the longitudinal direction is bent in a tubular shape such that the pair of end edges approaches each other to form the second side wall portion, and depressed portions bending toward the inside of the main terminal body portion and extending in the longitudinal direction are provided in a pair of respective wall portions having the pair of end edges forming the second side wall portion.

According to the terminal of the invention, the mating connector terminal inserted into the main terminal body portion is pushed by the leaf spring portion on an apex portion which has a curved shape when the depressed portions of the pair of respective wall portions forming the second side wall portion are viewed from the inside of the main terminal body portion. In this instance, even when a shape of the mating connector terminal or the tubular-shaped main terminal body portion is distorted, the distortion may be absorbed when the pair of respective wall portions forming the second side wall portion moves such that the tubular-shaped main terminal body portion is opened due to elasticity of the metal plate. In addition, since the mating connector terminal is pushed on the curved-shaped apex portion in the depressed portions of the pair of respective wall portions, the mating connector terminal easily comes into contact with the pair of respective wall portions when compared to a case in which the depressed portions are not provided in the pair of respective wall portions. In this way, distortion of the mating connector terminal may be absorbed by smoothly moving the pair of respective wall portions according to the distortion. When the distortion is absorbed, a position of the mating connector terminal may be stabilized inside the main terminal body portion. As a result, sufficient electric connection with the mating connector terminal may be obtained. Further, since distortion of the shape of the mating connector terminal or the tubular-shaped main terminal body portion is absorbed by movement of the pair of respective wall portions, the mating connector terminal or the main terminal body portion may not be too precisely manufactured, and manufacturing cost may be suppressed. As described above, according to the terminal of the invention, it is possible to obtain sufficient electric connection with the mating connector terminal while suppressing manufacturing cost.

In addition, in the terminal of the invention, preferably, end edge portions corresponding to at least a portion of the pair of end edges form a portion of the depressed portions, and the end edge portions are positioned closer to the inside of the main terminal body portion than from edges on opposite sides from the end edge portions in the depressed portions.

According to this suitable terminal, when the pair of respective wall portions moves such that the tubular-shaped main terminal body portion is opened to absorb the distortion, the end edge portions, the amount of movement of which is largest, forming the portion of the depressed portions in the pair of end edges are positioned closer to the inside of the main terminal body portion than from the edges on the opposite sides in the depressed portions. For this reason, even when the pair of respective wall portions moves such that the tubular-shaped main terminal body portion is opened, a little margin is present until the end edge portions of the pair of respective end edges move beyond the edges on the opposite sides in the depressed portions. As a result, even when the pair of respective wall portions moves, and the main terminal body portion is slightly deformed, it is possible to suppress change of an envelope shape of the main terminal body portion due to the deformation.

In addition, in the terminal of the invention, preferably, the main terminal body portion is formed in a shape of a rectangular tube in which the first side wall portion and the second side wall portion form a pair of opposing walls, and depressions extending in a direction intersecting corner portions are provided in the corner portions forming boundaries between the second side wall portion and a pair of respective third side wall portions connecting the first side wall portion to the second side wall portion.

According to this suitable terminal, excessive movement is suppressed by the depressions provided in the corner portions forming the boundaries between the second side wall portion and the pair of respective third side wall portions when the pair of respective wall portions forming the second side wall portions moves. In this way, the deformation of the main terminal body portion may be suppressed to a necessary minimum.

In addition, in the terminal of the invention, preferably, an approach hole for locking a lance entering the inside of the main terminal body portion from the terminal housing chamber is formed in the side wall of the main terminal body portion, the edge portion is a portion positioned on an extension of the approach hole to a side of the opening in the edge of the opening, the first side wall portion is a portion obtained by extending a region having the edge portion and the approach hole formed therein in the side wall in the longitudinal direction of the main terminal body portion, the leaf spring portion turns back to a side of the approach hole from the edge portion, and extends in a convex shape toward the second side wall portion to press the mating connector terminal to the second side wall portion while coming into contact with the mating connector terminal at an apex portion, an end portion of the leaf spring portion is positioned on the side of the opening from the approach hole, and a pair of arm portions branching toward a pair of third side wall portions connecting the first side wall portion to the second side wall portion is formed in the end portion, a width of the pair of arm portions being narrower than a width before branching, and contact portions serving as fulcrums of the arm portions when the mating connector terminal is inserted and the leaf spring portion is pressed by the mating connector terminal from a side of the second side wall portion are formed in the pair of respective third side wall portions.

That is, the terminal of the invention mentioned herein is a terminal made of metal including a main terminal body portion extending in a tubular shape into which a mating connector terminal is inserted from an opening at a distal end, and the terminal is accommodated in a terminal housing chamber provided in a housing of a connector. Herein, in the main terminal body portion, an approach hole for locking a lance entering the inside of the main terminal body portion from the terminal housing chamber is formed in the side wall of the tubular shape of the main terminal body portion, and a leaf spring portion is formed to turn back to the approach hole side from an edge portion which is an extension of the approach hole to the opening side in the edge of the opening to come into contact with the inserted mating connector terminal. The leaf spring portion extends in a convex shape toward the second side wall portion facing the first side wall portion obtained by extending a region having the edge portion and the approach hole formed therein in the side wall in the longitudinal direction of the main terminal body portion, and presses the mating connector terminal to the second side wall portion while coming into contact with the mating connector terminal at an apex portion. Further, an end portion of the leaf spring portion is positioned on the opening side from the approach hole, and a pair of arm portions branching toward a pair of third side wall portions connecting the first side wall portion to the second side wall portion is formed in the end portion. Here, a width of the pair of arm portions is narrower than a width before branching. Furthermore, contact portions serving as fulcrums of the arm portions when the mating connector terminal is inserted and the leaf spring portion is pressed by the mating connector terminal from a side of the second side wall portion are formed in the pair of respective third side wall portions.

Herein, in the terminal 700 illustrated in FIG. 19 to FIG. 21, when the male terminal on the other side is inserted, the leaf spring portion 723 is elastically deformed such that the contact portion 723*b* of the leaf spring portion 723 is pushed by the male terminal to approach the bottom wall 722 as described above. In this instance, when the amount of deformation of the leaf spring portion 723 is large, there is a concern about interference with the lance 73*b* entering from the approach hole 722*a* of the bottom wall 722. Meanwhile, a contact load based on a restoring force at the time of elastic deformation of the leaf spring portion 723 manages electric connection between the terminal 700 and the male terminal on the other side. For this reason, with regard to elastic deformation, the amount of deformation needs to correspond to a level at which a sufficient contact load for electric connection is obtained. In this regard, a spring constant of the leaf spring portion 723 may be increased such that a sufficiently high contact load can be obtained even when the amount of elastic deformation is small.

FIG. 22 is a schematic graph illustrating a relationship between a contact load and the amount of elastic deformation in the leaf spring portion illustrated in FIG. 19 to FIG. 21. In the graph G1 of FIG. 22, a horizontal axis indicates the amount of elastic deformation, and a vertical axis indicates a contact load. Further, two lines L1 and L2 indicating a relationship between a contact load and the amount of elastic deformation with respect to two types of leaf spring portions 723 having different spring constants are depicted in the graph G1. The line L1 depicted as a dotted line indicates a relationship when the spring constant is relatively low, and the line L2 depicted as a solid line indicates a relationship when the spring constant is relatively high. In addition, with regard to the contact load, a proper load range WA necessary and sufficient for electric connection between the terminal 700 and the male terminal on the other side is indicated in the graph G1.

In an example of FIG. 22, the leaf spring portion 723 is a so-called linear spring. As indicated by the two lines L1 and L2, the relationship between a contact load and the amount of elastic deformation is a linear relationship. Thus, when the amount of elastic deformation increases, the contact load increases in proportion to the amount. When the spring constant of the leaf spring portion 723 is increased, a slope of the linear relationship becomes large, and the increased amount of contact load with respect to the increase in amount of elastic deformation becomes large.

Herein, the amount of elastic deformation in the leaf spring portion 723 is determined based on a thickness of the male terminal inserted into the main terminal body portion 720. In this instance, even though the thickness of the male terminal falls within a range of a fabrication tolerance, a slight variation is present. Further, as understood from the line L2 of the graph G1, in the leaf spring portion 723 having an increased spring constant, a contact load may be lower than the proper load range WA and correspond to an insufficient load when a male terminal having a thickness on a thinnest side in a tolerance range is inserted. On the contrary, a contact load may be higher than the proper load range WA and correspond to an excessive load when a male terminal having a thickness on a thickest side in the tolerance range is inserted. There is a concern that electric connection becomes insufficient at the time of the insufficient load, and there is a concern that the terminal 700 or the male terminal is damaged at the time of the excessive load.

According to the terminal of the invention, since the end portion of the leaf spring portion on the opposite side from the opening side of the main terminal body portion is positioned on the opening side from the approach hole of the lance, interference between the lance and the leaf spring portion is avoided regardless of the amount of elastic deformation of the leaf spring portion. In addition, the leaf spring portion is supported by the edge portion serving as a starting point of turning back, and the end portion having the pair of arm portions. Further, the leaf spring portion comes into contact with the mating connector terminal at the convex-shaped apex portion headed for the second side wall portion. For this reason, a high contact load may be obtained when compared to a case in which the leaf spring portion is formed such that the previous turning-back and extending end portion is free and the leaf spring portion comes into contact with the mating connector terminal at the end portion unlike the invention. Further, according to the terminal of the invention, the pair of respective arm portions branching at the end portion of the leaf spring portion and having a narrower width than before branching is supported by the contact portions at the time of elastic deformation of the leaf spring portion. At the time of elastic deformation of the leaf spring portion, a whole spring constant in the leaf spring portion is suppressed when the pair of respective arm portions supported by the contact portions warps. According to the terminal of the invention, when a contact load is prevented from excessively increasing by suppression of a spring constant as described above while obtaining a high contact load by support at positions interposing the apex portion therebetween, it is possible to obtain a contact load falling within the proper load range WA indicated in the graph G1 of FIG. 22. As described above, according to the terminal of the invention, it is possible to obtain a necessary and sufficient contact load for electric connection with the mating connector terminal while avoiding interference between the lance and the leaf spring portion.

In addition, in the terminal of the invention, preferably, a slit extending to the side of the opening of the main terminal body portion is provided between the pair of arm portions in the end portion of the leaf spring portion.

According to this suitable terminal, a portion divided by the slit easily warps at the time of elastic deformation of the leaf spring portion, and the portion contributes to suppression of a spring constant together with the pair of arm portions. In this instance, a length of the pair of arm portions is determined based on gaps between the leaf spring portion and the third side wall portions to some extent. However, a depth of the slit may be freely set at the time of design when compared to the length of the arm portions. For this reason, according to this suitable terminal, a degree of freedom with respect to suppression of a spring constant increases, and a design freedom is increased when a necessary and sufficient contact load for electric connection is obtained.

In addition, in the terminal of the invention, preferably, through-holes are provided at positions to which distal ends of the pair of respective arm portions are headed in the pair of third side wall portions, the contact portions are inner edge portions in inner edges of the through-holes with which the pair of arm portions comes into contact when the leaf spring portion is pushed by the mating connector terminal, and the inner edge portions are linearly inclined in a direction approaching the first side wall portion as becoming more distant from the opening.

According to this suitable terminal, the inner edge portions with which the pair of arm portions comes into contact are linearly inclined in a direction approaching the first side wall portion. For this reason, for example, it is possible to suppress concentration of excessive stress on a base of the arm portions, etc. by allowing the pair of respective arm portions to slide along the inner edge portions and escape to the first side wall portion side when the apex portion in the leaf spring portion is pushed by the mating connector terminal to the first side wall portion side, and the leaf spring portion is elastically deformed. In this way, when the mating connector terminal is repeatedly inserted and extracted, for example, it is possible to suppress occurrence of setting of the leaf spring portion such as plastic deformation of the arm portions.

In addition, in the terminal of the invention, preferably, the contact portions are racks protruding from the pair of respective third side wall portions toward the inside of the main terminal body portion.

According to this suitable terminal, when the leaf spring portion is elastically deformed, the racks with which the pair of arm portions comes into contact warps toward the first side wall portion. For this reason, for example, it is possible to suppress concentration of excessive stress on the base of the arm portions, etc. by allowing the pair of respective arm portions to escape to the first side wall portion side when the leaf spring portion is elastically deformed. In this way, when the mating connector terminal is repeatedly inserted and extracted, for example, it is possible to suppress occurrence of setting of the leaf spring portion such as plastic deformation of the arm portions.

In addition, in the terminal of the invention, preferably, the leaf spring portion is formed such that a width in the apex portion is wider than a width in a portion on the side of the opening from the apex portion.

According to this suitable terminal, the width in the apex portion on which stress causing the convex shape to open is prone to be concentrated at the time of elastic deformation is wide in the leaf spring portion, and strength with respect to the opening is increased. In this way, when the mating connector terminal is repeatedly inserted and extracted, it is possible to suppress occurrence of setting of the leaf spring portion such as opening of the convex shape due to plastic deformation.

In addition, in the terminal of the invention, preferably, the leaf spring portion includes a portion having a certain width narrower than a width of the edge portion on a side of the apex portion in between the edge portion and the apex portion.

According to this suitable terminal, at the time of elastic deformation of the leaf spring portion, when the portion having the certain width formed to be narrow as described above warps, it is possible to suppress concentration of stress on the pair of arm portions. In this way, when the mating connector terminal is repeatedly inserted and extracted, for example, it is possible to suppress occurrence of setting of the leaf spring portion such as plastic deformation of the arm portions.

In addition, in this suitable terminal, more preferably, a width gradually decreases from the edge portion to the portion having the certain width.

According to this more suitable terminal, when the leaf spring portion is elastically deformed, it is possible to suppress concentration of stress from the edge portion to the portion having the certain width, and to further suppress occurrence of setting of the leaf spring portion.

In addition, in order to solve the above issue, a connector of the invention includes: a housing in which a terminal housing chamber is provided; and a terminal made of metal including a main terminal body portion extending in a tubular shape into which a mating connector terminal is inserted from an opening at a distal end, the terminal being accommodated in the terminal housing chamber, wherein the terminal is the terminal of the invention described above.

According to the connector of the invention, since the terminal thereof is the terminal of the invention described above, it is possible to obtain sufficient electric connection with the mating connector terminal while suppressing manufacturing cost.

In addition, according to the connector of the invention, since the terminal thereof is the terminal of the invention described above, it is possible obtain a necessary and sufficient contact load for electric connection with the mating connector terminal while avoiding interference between the lance and the leaf spring portion.

According to the terminal and the connector of the invention, it is possible to obtain sufficient electric connection with the mating connector terminal while suppressing manufacturing cost.

DETAILED DESCRIPTION

First, a description will be given of a schematic configuration common to connectors in first to fifth embodiments of the invention with reference to FIG. 1.

Figure 1:
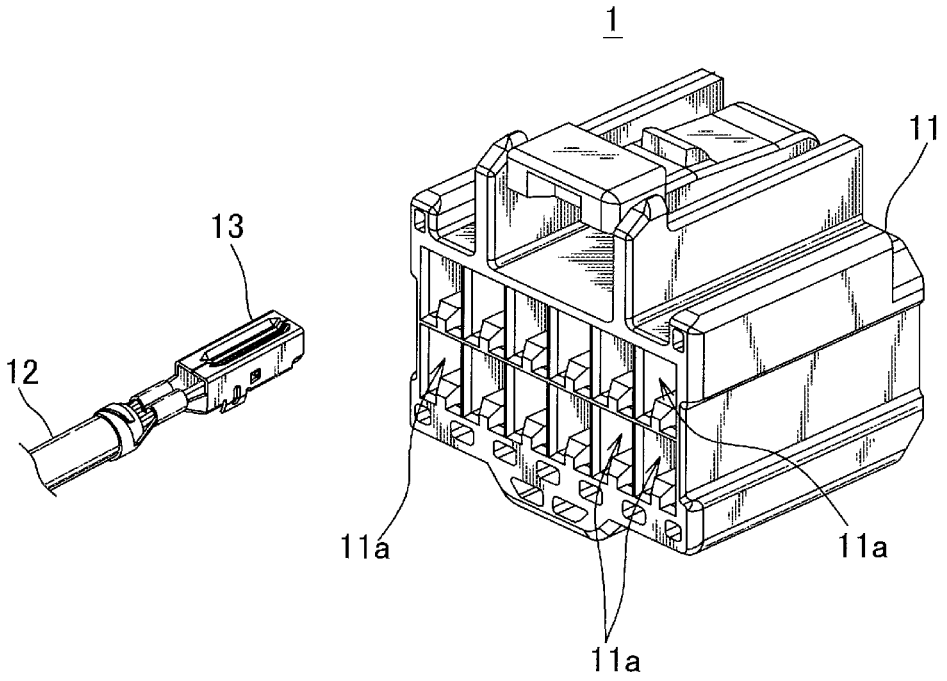
FIG. 1 is a diagram illustrating a schematic configuration common to connectors in first to fifth embodiments of the invention.

FIG. 1 is a diagram illustrating a schematic configuration common to connectors in first to fifth embodiments of the invention. A perspective view of a connector 1 is illustrated in FIG. 1.

The connector 1 illustrated in FIG. 1 includes a resin housing 11 and a metal terminal 13. Twelve terminal housing chambers 11*a* are provided in the housing 11 by being arranged in 2 by 6. The terminal 13 is fixed to a distal end of an electric wire 12 that forms a wire harness (not illustrated), and accommodated in the terminal housing chambers 11*a*. An opposite side from a side at which the electric wire 12 extends (front side) in each of the terminal housing chambers 11*a* is opened to serve as a terminal insertion opening into which a terminal of a connector on the other side (not illustrated) is inserted.

The connector 1 illustrated in FIG. 1 is a female connector, and the terminal 13 thereof is a female terminal into which a pin-shaped male terminal serving as the mating connector terminal is inserted. FIG. 1 representatively illustrates only one electric wire with a terminal in which the terminal 13 is fixed to the distal end of the electric wire 12.

Next, the respective first to fifth embodiments of the invention will be described. These embodiments are different from one another in configuration of a terminal to which reference numeral 13 is representatively assigned in FIG. 1. Hereinafter, each of the embodiments will be described, and the description will focus on a terminal.

First, the terminal of the first embodiment will be described with reference to FIG. 2 to FIG. 13.

Figure 2:
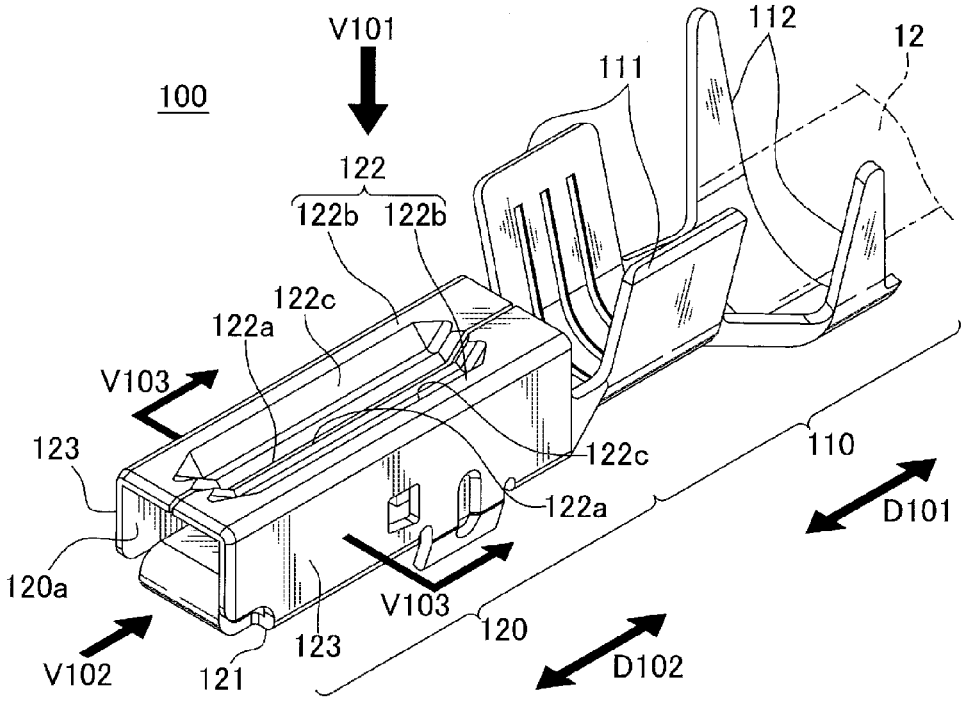
FIG. 2 is an external perspective view illustrating a state of a terminal of the first embodiment before the terminal is fixed to an electric wire.
Figure 3:
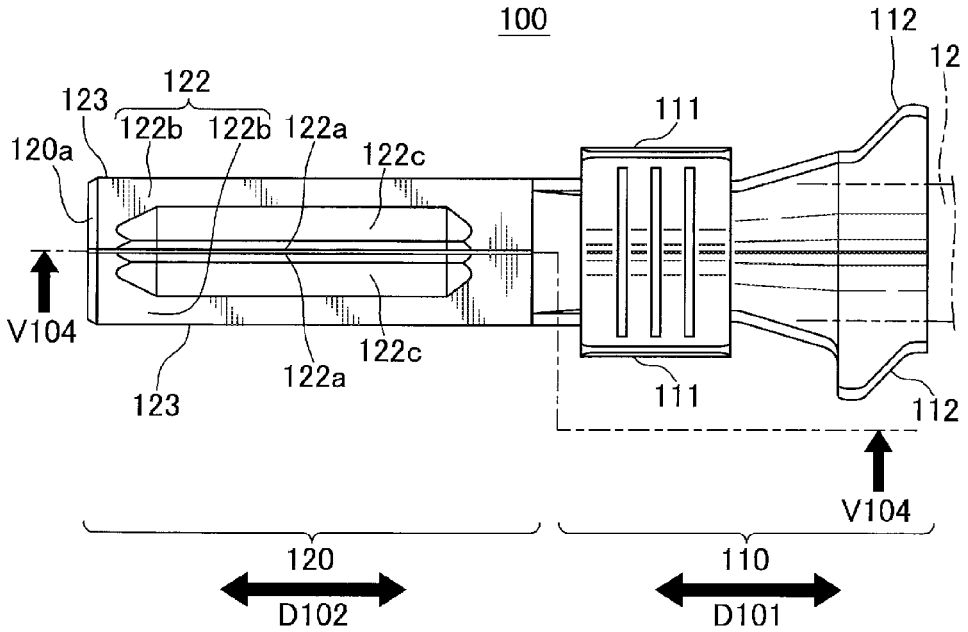
FIG. 3 is a diagram illustrating a V101 arrow view of FIG. 2 of the terminal illustrated in FIG. 2.
Figure 4A:
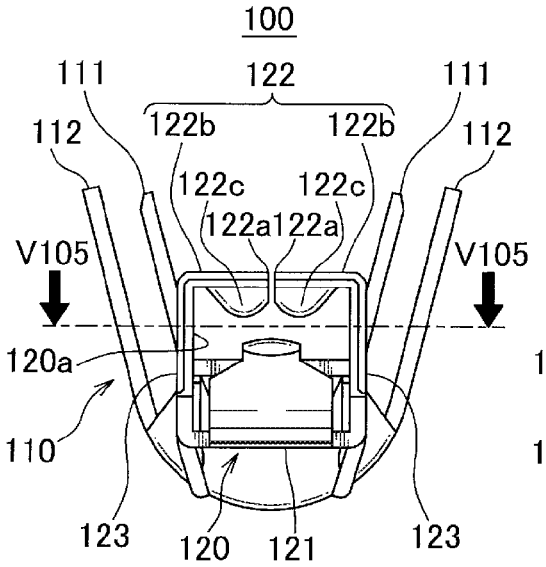
FIG. 4A is a diagram illustrating a V102 arrow view of FIG. 2 and a V103-V103 cross section of FIG. 2 of the terminal illustrated in FIG. 2.
Figure 4B:
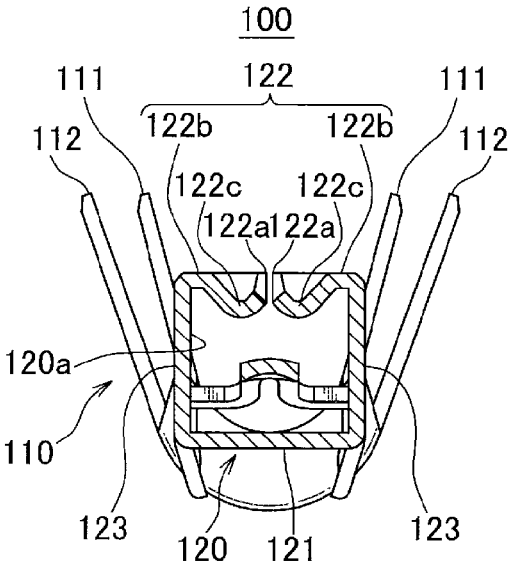
FIG. 4B is a diagram illustrating the V102 arrow view of FIG. 2 and the V103-V103 cross section of FIG. 2 of the terminal illustrated in FIG. 2.

FIG. 2 is an external perspective view illustrating a state of the terminal of the first embodiment before the terminal is fixed to an electric wire, and FIG. 3 is a diagram illustrating a V101 arrow view of FIG. 2 of the terminal illustrated in FIG. 2. In addition, FIG. 4A and FIG. 4B are diagrams illustrating a V102 arrow view of FIG. 2 and a V103-V103 cross section of FIG. 2 of the terminal illustrated in FIG. 2. FIG. 4A is a diagram illustrating the V102 arrow view, and FIG. 4B is a diagram illustrating the V103-V103 cross section.

A terminal 100 is a female terminal into which a pin-shaped male terminal is inserted, and is formed by integrating an electric wire fixed portion 110 fixed to a distal end of an electric wire 12 with a main terminal body portion 120 electrically connected to a male terminal of a connector on the other side.

The electric wire fixed portion 110 includes a pair of conductor caulking pieces 111 and a pair of covering caulking pieces 112. The conductor caulking pieces 111 are caulked and fixed to a conductor, which is exposed since insulating coating thereof is removed, at the distal end of the electric wire 12. The covering caulking pieces 112 are provided adjacent to the conductor caulking pieces 111 and caulked and fixed to resin coating around the conductor.

The main terminal body portion 120 is formed to extend in a tubular shape from the electric wire fixed portion 110 on an opposite side from the electric wire 12 side in a longitudinal direction D101 of the electric wire 12 to which the electric wire fixed portion 110 is fixed. The male terminal of the connector on the other side is inserted into and electrically connected to the main terminal body portion 120 from an opening 120*a* on an opposite side from the electric wire fixed portion 110. In the present embodiment, the main terminal body portion 120 is formed in a shape of a rectangular tube having a bottom wall 121 (a first side wall portion), a ceiling wall 122 (a second side wall portion) facing the bottom wall 121, and a pair of lateral walls 123 (a third side wall portion) that connects the bottom wall 121 to the ceiling wall 122 and faces each other.

In addition, as illustrated in FIG. 4A and FIG. 4B, the main terminal body portion 120 is bent in the shape of the rectangular tube such that a metal plate having a pair of end edges 122*a* extending in parallel with each other in a longitudinal direction D102 of the main terminal body portion 120 forms the ceiling wall 122 by the pair of end edges 122*a* which approach each other. Further, depressed portions 122*c* bending toward an inside of the main terminal body portion 120 and extending in the longitudinal direction D102 of the main terminal body portion 120 are provided in the pair of respective wall portions 122*b* having the pair of end edges 122*a* which forms the ceiling wall 122.

In addition, in the present embodiment, as illustrated in FIG. 4B, the depressed portions 122*c* of the pair of respective wall portions 122*b* have a cross-sectional shape perpendicular to the longitudinal direction D102 of the main terminal body portion 120 corresponding to a valley shape as below. That is, the cross-sectional shape of the depressed portions 122*c* is the valley shape which reaches a bottom by descending from external surfaces of the pair of respective wall portions 122*b* toward the inside of the main terminal body portion 120, and reaches the pair of respective end edges 122*a* while ascending from the bottom up to a position flush with the external surfaces of the wall portions 122*b*.

Next, the main terminal body portion 120 will be described, and the description will focus on an internal configuration thereof.

Figure 5:
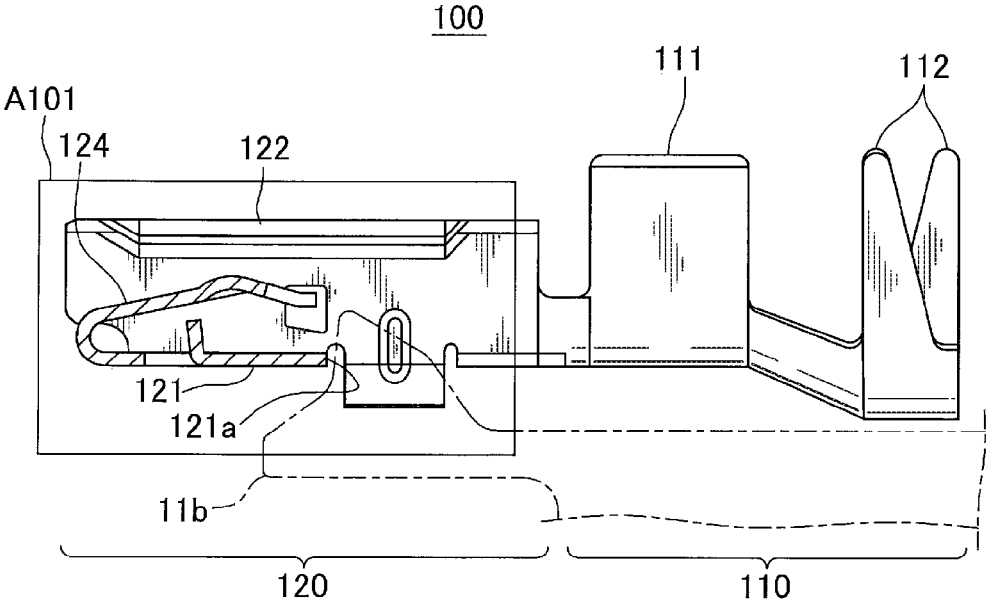
FIG. 5 is a cross-sectional view illustrating a V104-V104 cross section of FIG. 3 of the terminal illustrated in FIG. 3.
Figure 6:
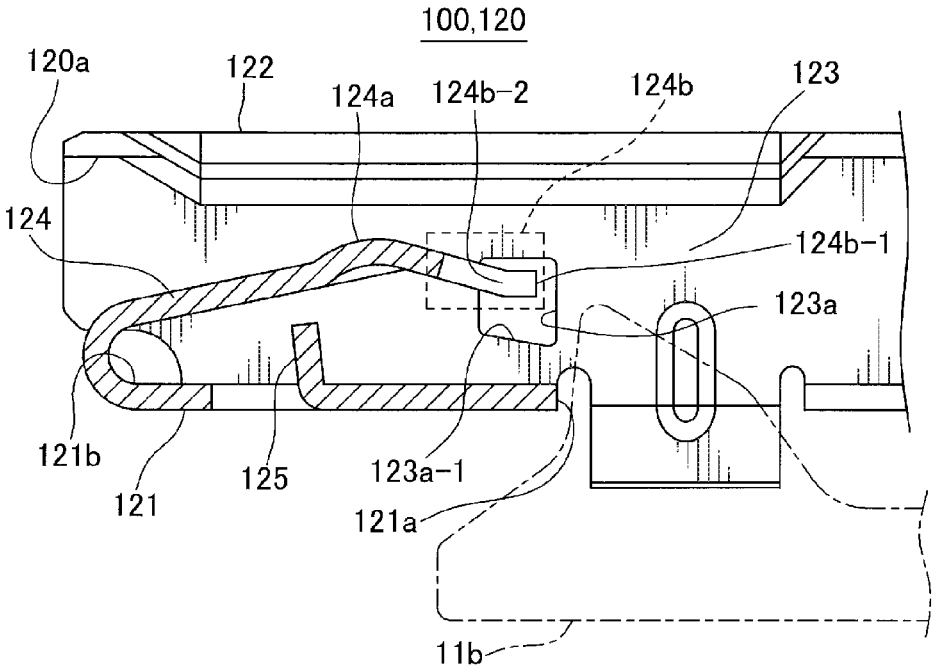
FIG. 6 is an enlarged view of an area A101 corresponding to a main terminal body portion in FIG. 5.
Figure 7:
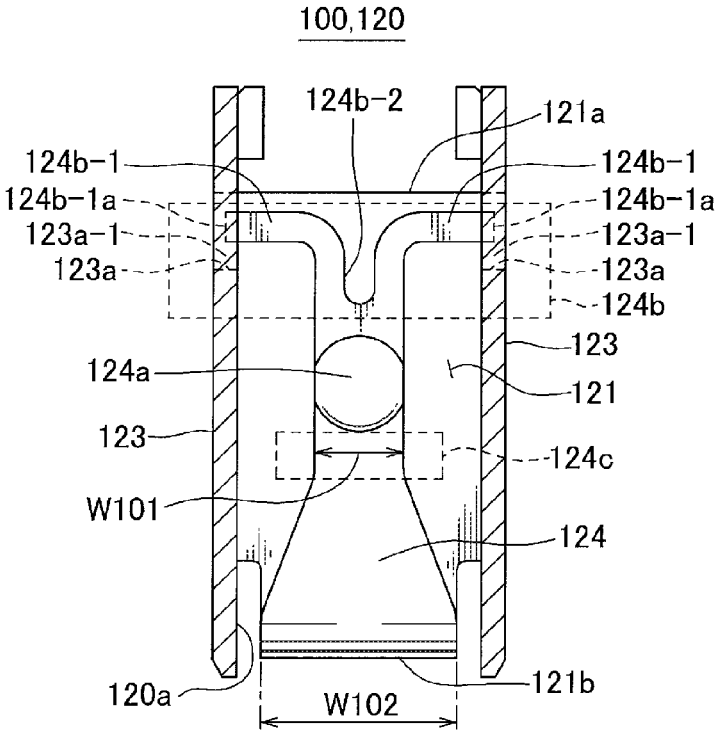
FIG. 7 is a cross-sectional view illustrating a V105-V105 cross section of FIG. 4A and FIG. 4B of the main terminal body portion in the terminal illustrated in FIG. 4A and FIG. 4B.
Figure 8:
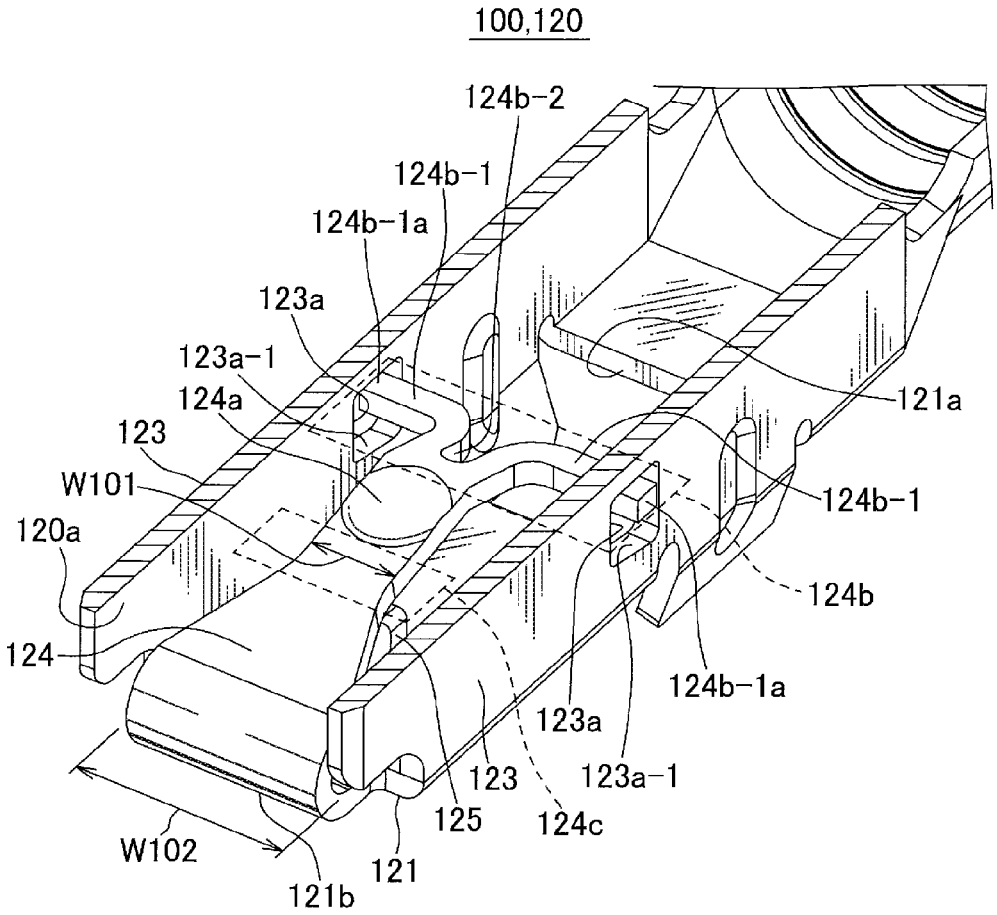
FIG. 8 is a perspective view illustrating the main terminal body portion such that an internal configuration thereof is seen by removing a ceiling wall.

FIG. 5 is a cross-sectional view illustrating a V104-V104 cross section of FIG. 3 of the terminal illustrated in FIG. 3, and FIG. 6 is an enlarged view of an area A101 corresponding to the main terminal body portion in FIG. 5. In addition, FIG. 7 is a cross-sectional view illustrating a V105-V105 cross section of FIG. 4A and FIG. 4B of the main terminal body portion in the terminal illustrated in FIG. 4A and FIG. 4B. FIG. 8 is a perspective view illustrating the main terminal body portion such that the internal configuration thereof is seen by removing the ceiling wall.

First, in the terminal housing chambers 11*a* in the housing 11 of the connector 1 illustrated in FIG. 1, as indicated by an alternated long and short dash line in FIG. 5 and FIG. 6, a lance 11*b*, which is locked by entering the inside of the main terminal body portion 120 of the terminal 100 from the terminal housing chambers 11*a*, is provided. An approach hole 121*a* for the lance 11*b* is provided in the bottom wall 121 of the main terminal body portion 120. The lance 11*b* is formed to be elastically deformable. The lance 11*b* is elastically deformed to allow the main terminal body portion 120 to pass therethrough when the terminal 100 is inserted into the terminal housing chamber 11*a* of the housing 11, and the lance 11*b* is restored to enter the inside of the main terminal body portion 120 and locked when the approach hole 121*a* reaches up to a position of the lance 11*b*. When the lance 11*b* is locked, the terminal 100 is accommodated in the terminal housing chamber 11*a* in a retained state.

A leaf spring portion 124 described below is provided as a structure for electric connection with the inserted male terminal in the main terminal body portion 120. As illustrated in FIG. 6 to FIG. 8, the leaf spring portion 124 extends in a band shape from an edge portion 121*b* (that is, an edge of the bottom. wall 121 on the opening 120*a* side) which is an extension of the approach hole 121*a* for the lance 11*b* in an edge of the opening 120*a*. Further, the leaf spring portion 124 is formed to turn back to the approach hole 121*a* side to the inside of the main terminal body portion 120 at the edge portion 121*b* thereof.

In addition, the leaf spring portion 124 extends to the inside of the main terminal body portion 120 in a convex shape which is curved by bending in the middle convexly toward the ceiling wall 122. A contact portion 124*a*, which protrudes more convexly toward the ceiling wall 122 and in a nearly circular shape when viewed from the ceiling wall 122 side, and comes into contact with the male terminal of the connector on the other side when the male terminal in inserted into the opening 120*a*, is provided at a convex-shaped apex portion in the leaf spring portion 124. In the present embodiment, the contact portion 124*a* corresponds to an example of the apex portion mentioned in the invention.

Figure 9:
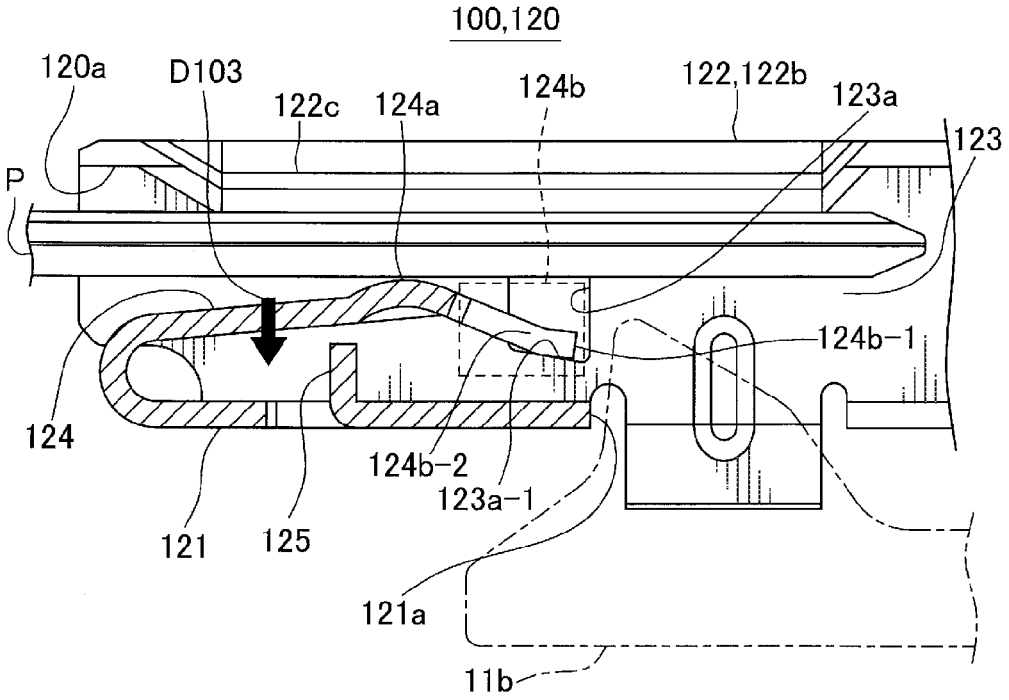
FIG. 9 is a diagram illustrating the main terminal body portion in a state in which a male terminal of a connector on the other side is inserted into an opening with respect to an enlarged cross section similar to that of FIG. 6.
Figure 10:
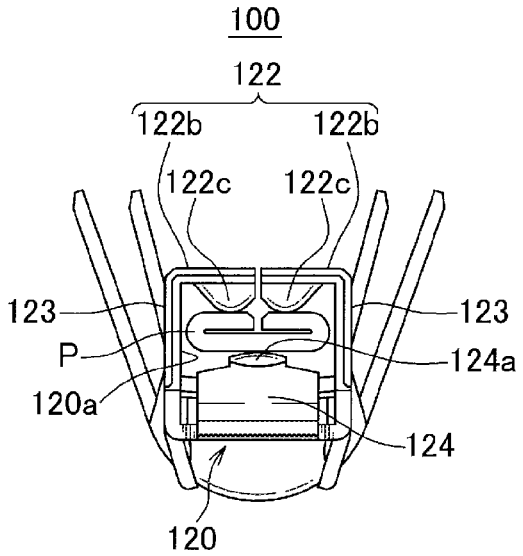
FIG. 10 is a diagram illustrating the main terminal body portion in the state in which the male terminal of the connector on the other side is inserted into the opening with respect to the V102 arrow view of FIG. 2 similarly to FIG. 4A and FIG. 4B.

FIG. 9 is a diagram illustrating the main terminal body portion in a state in which the male terminal of the connector on the other side is inserted into the opening with respect to an enlarged cross section similar to that of FIG. 6. FIG. 10 is a diagram illustrating the main terminal body portion in the state in which the male terminal of the connector on the other side is inserted into the opening with respect to the V102 arrow view of FIG. 2 similarly to FIG. 4A and FIG. 4B.

As illustrated in FIG. 9 and FIG. 10, when a male terminal P is inserted into the opening 120*a* of the main terminal body portion 120, the contact portion 124*a* of the leaf spring portion 124 comes into contact with the male terminal P, and the leaf spring portion 124 presses the male terminal P to the ceiling wall 122 at the contact portion 124*a*. The pressed male terminal P is pushed by the leaf spring portion 124 against the apex portion which has a curved shape when the depressed portions 122*c* of the pair of respective wall portions 122*b* forming the ceiling wall 122 are viewed from the inside of the main terminal body portion 120.

Herein, the leaf spring portion 124 is formed such that an end portion 124*b* on an opposite side from the opening 120*a* side of the main terminal body portion 120 is positioned on the opening 120*a* side from the approach hole 121*a* of the lance 11*b*. Further, the end portion 124*b* of the leaf spring portion 124 is formed in a substantially T-shaped form having a pair of arm portions 124*b*-1, which is narrower than a width of the leaf spring portion 124 in the contact portion 124*a* (a width before branching), branching to protrude toward the pair of respective lateral walls 123. In addition, a slit 124*b*-2 extending to the opening 120*a* side of the main terminal body portion 120 is provided between the pair of arm portions 124*b*-1 in the end portion 124*b*.

In addition, rectangular through-holes 123*a* are formed at positions for which each the pair of respective arm portions 124*b*-1 is headed in the pair of respective lateral walls 123. As illustrated in FIG. 9, when the male terminal P is inserted into the opening 120*a*, the contact portion 124*a* is pressed by the male terminal P, and the leaf spring portion 124 is elastically deformed in a direction of an arrow D103 of FIG. 9. Further, when the leaf spring portion 124 is elastically deformed in this way, distal ends 124*b*-1*a* of the pair of respective arm portions 124*b*-1 come into contact with inner edge portions 123*a*-1 on the bottom wall 121 side in inner edges of the above-described through-holes 123*a*. That is, the inner edge portions 123*a*-1 are contact portions serving as fulcrums with which the pair of arm portions 124*b*-1 comes into contact when the leaf spring portion is elastically deformed. In the present embodiment, the inner edge portions 123*a*-1 are linearly inclined in a direction approaching the bottom wall 121 as becoming more distant from the opening 120*a* of the main terminal body portion 120.

In addition, in the present embodiment, as illustrated in FIG. 7 and FIG. 8, the leaf spring portion 124 includes a portion 124*c*, which has a certain width W101 narrower than a width W102 of the edge portion 121*b*, provided on the contact portion 124*a* side (apex portion side) in between the edge portion 121*b* of the bottom wall 121 and the contact portion 124*a*. Further, the leaf spring portion 124 is formed in a shape having a width gradually decreasing from the edge portion 121*b* up to the portion 124*c* having the certain width W101.

Further, in the present embodiment, a portion of the bottom wall 121 is cut and raised toward the leaf spring portion 124 to provide a regulating portion 125 that regulates excessive displacement of the leaf spring portion 124 in the direction of the arrow D103. The regulating portion 125 is cut and raised toward a surface of the portion 124*c* having the certain width W101 on the bottom wall 121 side, and a distal end edge thereof comes into contact with the surface of the portion 124*c* having the certain width W101 on the bottom wall 121 side, thereby regulating excessive displacement of the leaf spring portion 124.

The terminal 100 having the above-described shape is formed through sheet-metal processing for bending a metal plate cut out in a development shape as below.

Figure 11:
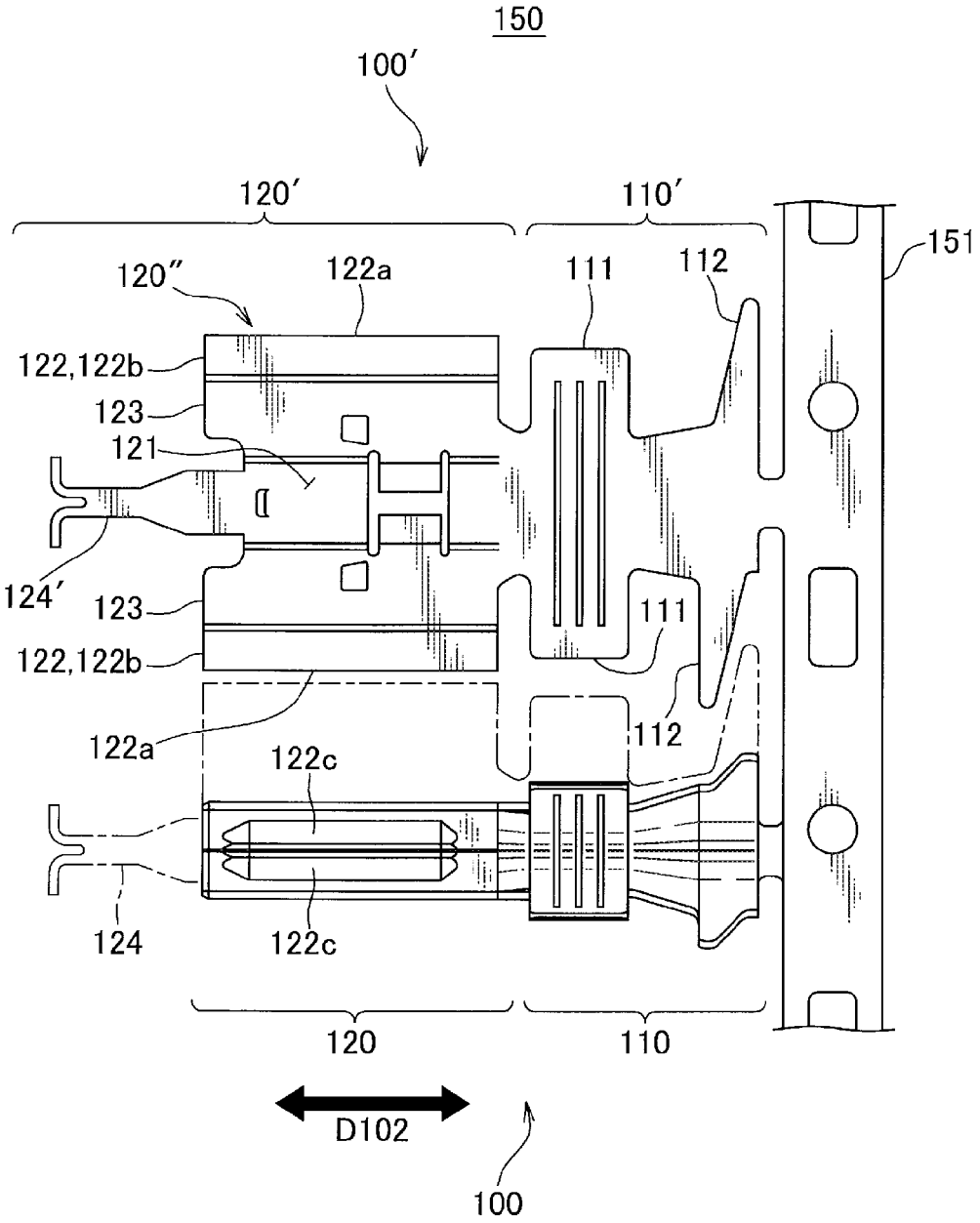
FIG. 11 is a diagram illustrating a metal plate cut out in a development shape of the terminal illustrated in FIG. 1 to FIG. 10.

FIG. 11 is a diagram illustrating a metal plate cut out in a development shape of the terminal illustrated in FIG. 1 to FIG. 10.

A metal plate 150 illustrated in FIG. 11 has a shape in which a plurality of terminal corresponding plates 100' having a development shape of the terminal 100 is arranged side by side in a lengthwise direction of a band-shaped base 151 on the base 151. Each of the terminal corresponding plates 100' includes an electric wire fixed portion corresponding plate 110' having a development shape of the above-described electric wire fixed portion 110, and a main terminal body portion corresponding plate 120' having a development shape of the above-described main terminal body portion 120.

The electric wire fixed portion corresponding plate 110' has a shape in which each of the pair of conductor caulking pieces 111 and the pair of covering caulking pieces 112 is developed. The electric wire fixed portion 110 is formed by folding and raising each of the pair of conductor caulking pieces 111 and the pair of covering caulking pieces 112.

In addition, the main terminal body portion corresponding plate 120' includes a side wall corresponding plate 120" and a leaf spring portion corresponding plate 124'. The side wall corresponding plate 120" is a rectangular part in which the bottom wall 121, the pair of wall portions 122*b* forming the ceiling wall 122, and the pair of lateral walls 123 are developed. The leaf spring portion corresponding plate 124' is a part in which the leaf spring portion 124 extending from the bottom wall 121 in the side wall corresponding plate 120" is developed. The main terminal body portion 120 is formed by being bent in a shape of a rectangular tube such that the leaf spring portion corresponding plate 124' turns back, and the pair of end edges 122*a* extending in parallel with each other in the longitudinal direction D102 of the main terminal body portion 120 in the side wall corresponding plate 120" approaches each other to form the ceiling wall 122. In addition, formation of the depressed portions 122*c* in the pair of wall portions 122*b*, etc. is performed through pressing prior to bending.

According to the terminal 100 of the first embodiment described above, the end portion 124*b* of the leaf spring portion 124 on the opposite side from the opening 120*a* side of the main terminal body portion 120 is positioned on the opening 120*a* side from the approach hole 121*a* of the lance 11*b*. In this way, interference between the lance 11*b* and the leaf spring portion 124 is avoided regardless of the amount of elastic deformation of the leaf spring portion 124.

In addition, according to the terminal 100 of the present embodiment, since the leaf spring portion 124 is formed to be short such that the leaf spring portion 124 is positioned on the opening 120*a* side from the approach hole 121*a* of the lance 11*b*, the leaf spring portion corresponding plate 124' in each of the terminal corresponding plates 100' of the metal plate 150 illustrated in FIG. 11 is formed to be short. In the metal plate 150, the leaf spring portion corresponding plate 124' extends from the rectangular side wall corresponding plate 120", and a part between leaf spring portion corresponding plates 124' of the plurality of terminal corresponding plates 100' is cut out and discarded. In this instance, according to the terminal 100 of the present embodiment, since the leaf spring portion corresponding plate 124' is formed to be short as described above, yield may be improved by suppressing an area of the above-described discarded part.

In addition, according to the terminal 100 of the present embodiment, the leaf spring portion 124 is supported by the edge portion 121*b* serving as a starting point of turning back, and the end portion 124*b* having the pair of arm portions 124*b*-1. Further, the leaf spring portion 124 comes into contact with the male terminal P of the connector on the other side at the contact portion 124*a* corresponding to the convex-shaped apex portion which is bent in the middle convexly toward the ceiling wall 122 in between the edge portion 121*b* and the end portion 124*b*. For this reason, a high contact load may be obtained when compared to a case in which the leaf spring portion 124 is formed such that the turning-back end portion is free and the leaf spring portion 124 comes into contact with the male terminal at the end portion unlike the present embodiment.

Further, according to the terminal 100 of the present embodiment, the end portion 124*b* of the leaf spring portion 124 has the pair of arm portions 124*b*-1 narrower than the width W101 of the leaf spring portion 124 in the contact portion 124*a*. Furthermore, when the leaf spring portion 124 is elastically deformed, the pair of respective arm portions 124*b*-1 warps by coming into contact with the inner edge portions 123*a*-1 on the bottom wall 121 side in the through-holes 123*a* of the lateral walls 123.

Figure 12A:
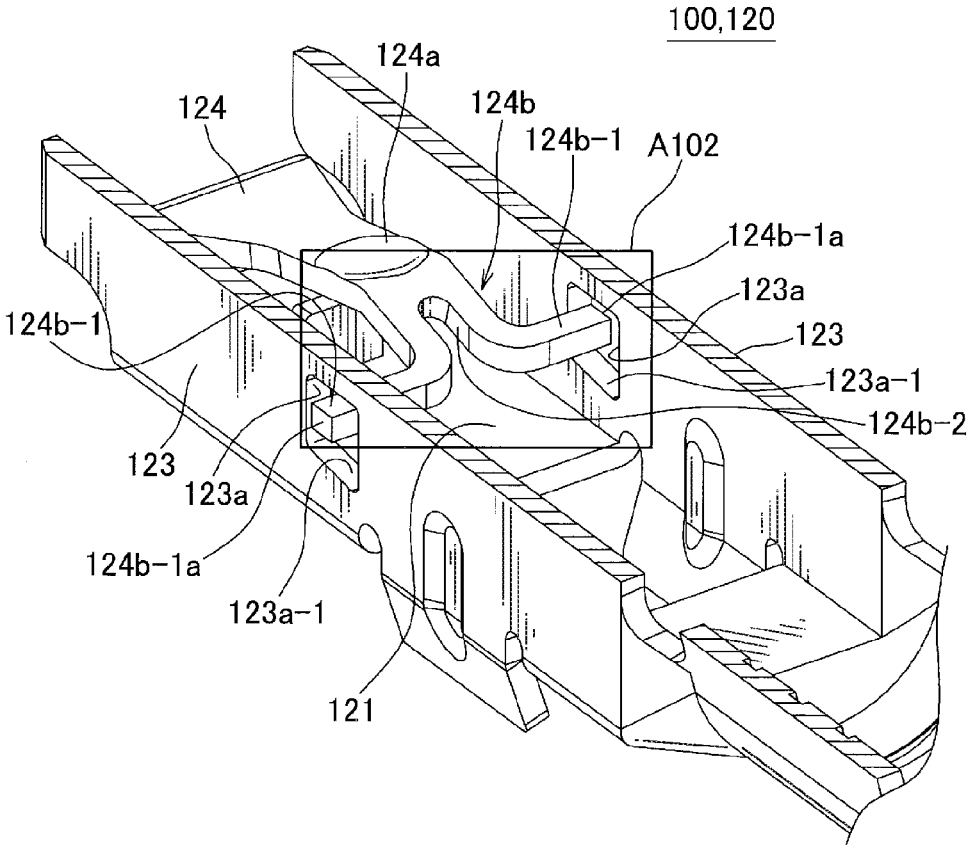
FIG. 12A is a perspective view illustrating an appearance in which a pair of respective arm portions of a leaf spring portion warps by coming into contact with inner edge portions of through-holes in a state in which the ceiling wall of the main terminal body portion is removed similarly to FIG. 8.
Figure 12B:
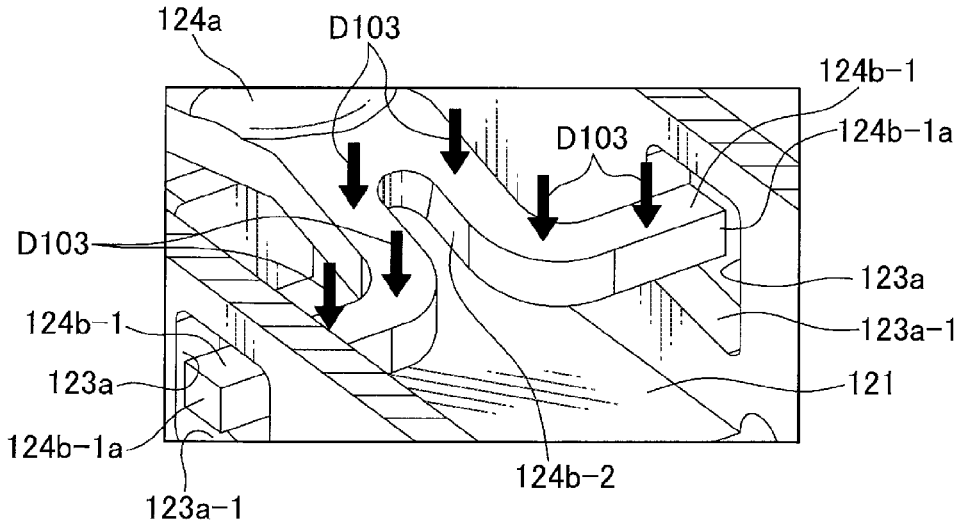
FIG. 12B is a perspective view illustrating an appearance in which the pair of respective arm portions of the leaf spring portion warps by coming into contact with the inner edge portions of the through-holes in the state in which the ceiling wall of the main terminal body portion is removed similarly to FIG. 8.

FIG. 12A and FIG. 12B are perspective views illustrating an appearance in which the pair of respective arm portions of the leaf spring portion warps by coming into contact with the inner edge portions of the through-holes in a state in which the ceiling wall of the main terminal body portion is removed similarly to FIG. 8. FIG. 12A illustrates a perspective view of the main terminal body portion 120, from which the ceiling wall 122 is removed, viewed from a side of the pair of arm portions 124*b*-1 of the leaf spring portion 124, and FIG. 12B illustrates an enlarged view of an area A102 of FIG. 12A.

Figure 22:
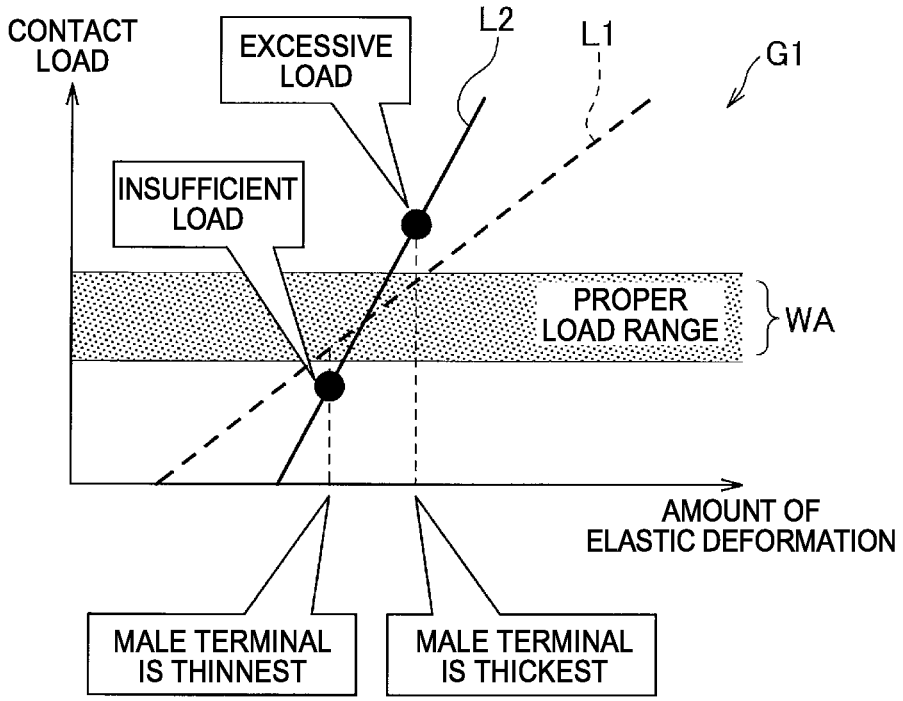
FIG. 22 PRIOR ART
FIG. 22 is a schematic graph illustrating a relationship between a contact load and the amount of elastic deformation in a leaf spring portion illustrated in FIG. 19 to FIG. 21.

As illustrated in FIG. 12A and FIG. 12B, when the leaf spring portion 124 is elastically deformed in the main terminal body portion 120, the pair of respective arm portions 124*b*-1 having a small width comes into contact with the inner edge portions 123*a*-1 of the through-holes 123*a* of the lateral walls 123 as described above. Further, the pair of respective arm portions 124*b*-1 warps in the direction of the arrow D103 which is the same as a deformation direction in which the leaf spring portion 124 is elastically deformed. In this way, a whole spring constant in the leaf spring portion 124 is suppressed. According to the terminal 100 of the present embodiment, first, a high contact load is obtained by support at positions interposing the contact portion 124*a* therebetween. Meanwhile, the contact load is prevented from being excessively increasing by suppressing the spring constant. In this way, it is possible to obtain a contact load that falls within a proper load range. In this way, it is possible to obtain a contact load that falls within a proper load range WA indicated by a graph G1 of FIG. 22. In this way, according to the terminal 100 of the present embodiment, it is possible to obtain a necessary and sufficient contact load for electric connection with the male terminal P of the connector on the other side while avoiding interference between the lance 11*b* and the leaf spring portion 124.

In addition, according to the terminal 100 of the present embodiment, the pair of arm. portions 124*b*-1 in the end portion 124*b* of the leaf spring portion 124 is divided by the slit 124*b*-2. For this reason, the divided portion easily warps when the leaf spring portion 124 is elastically deformed, and the portion contributes to suppression of the spring constant along with the pair of arm portions 124*b*-1. In this instance, while a length of the pair of arm portions 124*b*-1 is determined to a certain extent by a gap between the leaf spring portion 124 and the lateral walls 123, a depth of the slit 124*b*-2 may be freely set at the time of design when compared to the length of the arm portions 124*b*-1. For this reason, according to the terminal 100 of the present embodiment, a degree of free with respect to suppression of the spring constant increases, and a design freedom is increased when a necessary and sufficient contact load for electric connection is obtained.

In addition, according to the terminal 100 of the present embodiment, the inner edge portions 123*a*-1 with which the distal ends 124*b*-1*a* of the pair of respective arm portions 124*b*-1 come into contact are linearly inclined in the direction approaching the bottom wall 121. When the contact portion 124*a* in the leaf spring portion 124 is pushed to the bottom wall 121 side by the male terminal P on the other side, and the leaf spring portion 124 is elastically deformed, the distal ends 124*b*-1*a* of the pair of respective arm portions 124*b*-1 slide along the inner edge portions 123*a*-1, and escape to the bottom wall 121 side. As a result, for example, concentration of excessive stress is suppressed in a base of the arm portions 124*b*-1, etc. In this way, when the male terminal P is repeatedly inserted and extracted, for example, it is possible to suppress occurrence of setting of the leaf spring portion 124 such as plastic deformation of the arm portions 124*b*-1.

In addition, according to the terminal 100 of the present embodiment, as described above with reference to FIG. 7 and FIG. 8, the leaf spring portion 124 has the portion 124*c*, which has the certain width W101 narrower than the width W102 of the edge portion 121*b*, provided on the contact portion 124*a* side in between the edge portion 121*b* and the contact portion 124*a*. In this way, at the time of elastic deformation of the leaf spring portion 124, when the portion having the certain width W102 formed to be narrow as described above warps, it is possible to suppress concentration of stress on the pair of arm portions 124*b*-1. In this way, when the male terminal P is repeatedly inserted and extracted, for example, it is possible to suppress occurrence of setting of the leaf spring portion 124 such as plastic deformation of the arm portions 124*b*-1.

In addition, according to the terminal 100 of the present embodiment, a width gradually decreases from the edge portion 121*b* to the portion 124*c* having the certain width W101. In this way, when the leaf spring portion 124 is elastically deformed, it is possible to suppress concentration of stress from the edge portion 121*b* to the portion 124*c* having the certain width W101, and to further suppress occurrence of setting of the leaf spring portion 124.

In addition, according to the terminal 100 of the present embodiment, the inserted male terminal P on the other side is pushed by the leaf spring portion 124 against the apex portion which has the curved shape when the depressed portions 122*c* of the pair of respective wall portions 122*b* forming the ceiling wall 122 are viewed from the inside of the main terminal body portion 120.

Herein, a shape of the male terminal P on the other side may be slightly distorted even though the shape falls within a range of a fabrication tolerance. In addition, a shape of the main terminal body portion 120 corresponding to the shape of the rectangular tube may be slightly distorted within a range of a fabrication tolerance. In this instance, according to the terminal 100 of the present embodiment, when the male terminal P on the other side is inserted into the main terminal body portion 120, a position of the male terminal P inside the main terminal body portion 120 may be stabilized by absorbing the distortion as below.

Figure 13:
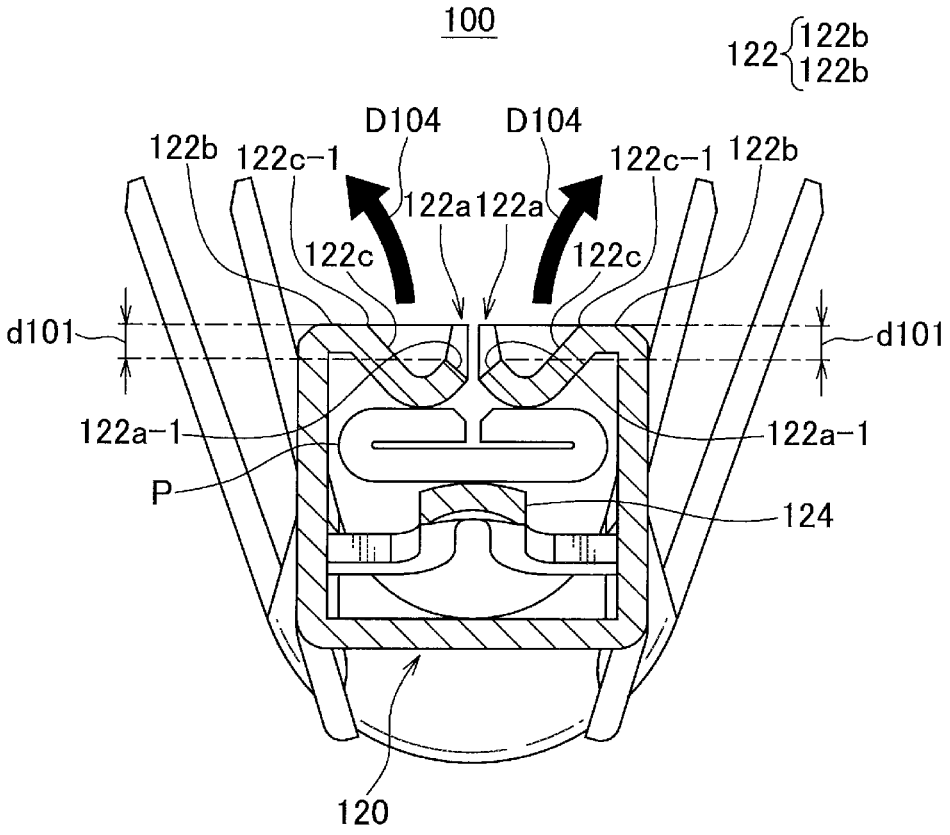
FIG. 13 is a diagram illustrating an appearance in which the male terminal on the other side is pushed by the leaf spring portion against an apex portion which has a curved shape when depressed portions of a pair of respective wall portions are viewed from an inside of the main terminal body portion as a cross-sectional diagram similar to FIG. 4B.

FIG. 13 is a diagram illustrating an appearance in which the male terminal on the other side is pushed by the leaf spring portion against the apex portion which has the curved shape when the depressed portions of the pair of respective wall portions are viewed from the inside of the main terminal body portion as a cross-sectional diagram similar to FIG. 4B.

According to the terminal 100 of the present embodiment, when the male terminal P on the other side is inserted into the main terminal body portion 120, the pair of respective wall portions 122*b* forming the ceiling wall 122 is configured to be movable as below. That is, the pair of respective wall portions 122*b* may move in a direction of an arrow D104 of FIG. 13 such that the main terminal body portion 120 having the shape of the rectangular tube is opened due to elasticity of the metal plate. Even when the shape of the male terminal P on the other side or the tubular-shaped main terminal body portion 120 is distorted, the distortion may be absorbed when the pair of respective wall portions 122*b* moves as described above according to the terminal 100 of the present embodiment.

In addition, according to the terminal 100 of the present embodiment, the male terminal P is pushed against the apex portion which has the curved shape when the depressed portions 122*c* of the pair of respective wall portions 122*b* are viewed from the inside of the main terminal body portion 120. For this reason, the male terminal P on the other side easily comes into contact with the pair of respective wall portions 122*b* when compared to a case in which the depressed portions are not provided in the pair of respective wall portions. In this way, distortion of the male terminal P may be absorbed by smoothly moving the pair of respective wall portions 122*b* according to the distortion. When the distortion is absorbed, the position of the male terminal P may be stabilized inside the main terminal body portion 120. As a result, sufficient electric connection with the male terminal P may be obtained.

Further, since distortion of the shape of the male terminal P or the tubular-shaped main terminal body portion 120 is absorbed by movement of the pair of respective wall portions 122*b*, the male terminal P or the main terminal body portion 120 may not be too precisely manufactured, and manufacturing cost may be suppressed. As described above, according to the terminal 100 of the present embodiment, it is possible to obtain sufficient electric connection with the male terminal P on the other side while suppressing manufacturing cost.

In addition, in the terminal 100 of the present embodiment, as described above, the cross-sectional shape of the above-described depressed portions 122*c* is the valley shape which reaches the bottom by descending from external surfaces of the pair of respective wall portions 122*b* toward the inside of the main terminal body portion 120, and reaches the pair of respective end edges 122*a* while ascending from the bottom up to the position flush with the external surfaces. That is, as illustrated in FIG. 13, end edge portions 122*a*-1 corresponding to at least a portion of the pair of end edges 122*a* forms a portion of the depressed portions 122*c*. Further, the end edge portions 122*a*-1 are positioned closer to the inside of the main terminal body portion 120 than from edges 122*c*-1 on opposite sides from the end edge portions 122*a*-1 in the depressed portions 122*c*.

In the terminal 100 of the present embodiment, when the pair of respective wall portions 122*b* moves in the direction of the arrow D104 to absorb the distortion, the amount of movement of the end edge portions 122*a*-1 forming the portion of the depressed portions 122*c* is largest in the pair of end edges 122*a*. Further, the end edge portions 122*a*-1 are positioned closer to the inside of the main terminal body portion 120 than from the edges 122*c*-1 on the opposite sides in the depressed portions 122*c*. For this reason, even when the pair of respective wall portions 122*b* moves, a little margin d101 is present until the end edge portions 122*a*-1 of the pair of respective end edges 122*a* move beyond the edges 122*c*-1 on the opposite sides in the depressed portions 122*c*. As a result, even when the pair of respective wall portions 122*b* moves, and the main terminal body portion 120 is slightly deformed, it is possible to suppress change of an envelope shape of the main terminal body portion 120 due to the deformation.

Further, according to the connector 1 (FIG. 1) including the above-described terminal 100 of the present embodiment, it is possible to obtain a necessary and sufficient contact load for electric connection with the male terminal P of the connector on the other side while avoiding interference between the lance 11*b* and the leaf spring portion 124. In addition, according to the connector 1, it is possible to obtain sufficient electric connection with the male terminal P of the connector on the other side while suppressing manufacturing cost.

Next, a terminal of a second embodiment will be described with reference to FIG. 14A and FIG. 14B. The terminal of the second embodiment is different from the terminal 100 of the first embodiment in shapes of depressed portions provided in a pair of respective wall portions forming a ceiling wall. Hereinafter, the terminal of the second embodiment will be described, and the description will focus on a difference from the terminal 100 of the first embodiment.

Figure 14A:
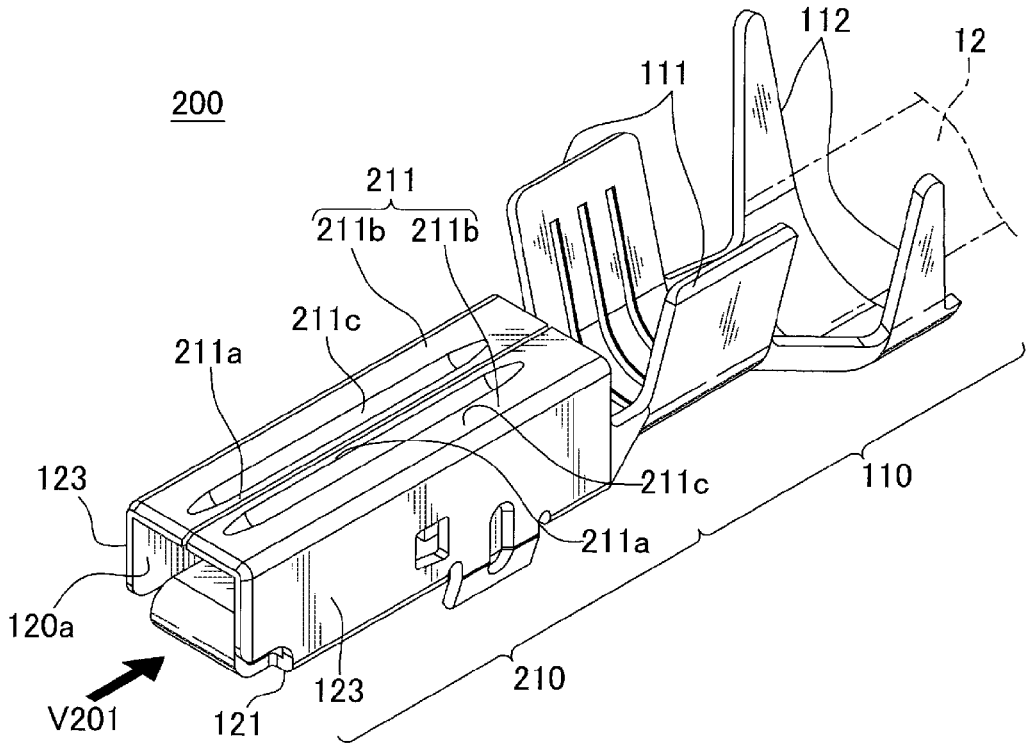
FIG. 14A is an external view illustrating a state of a terminal of a second embodiment before the terminal is fixed to an electric wire.
Figure 14B:
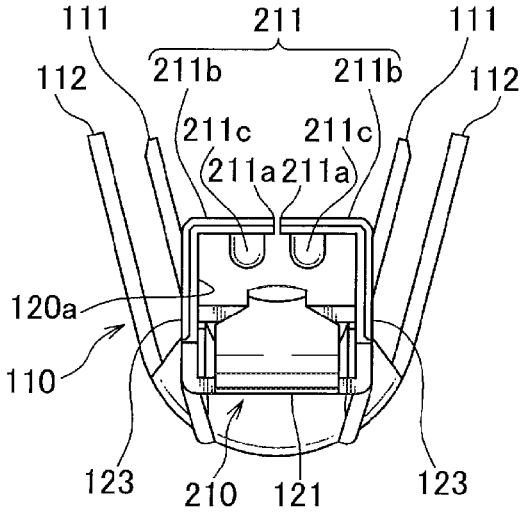
FIG. 14B is an external view illustrating the state of the terminal of the second embodiment before the terminal is fixed to the electric wire.

FIG. 14A and FIG. 14B are external views illustrating a state of the terminal of the second embodiment before the terminal is fixed to an electric wire. FIG. 14A illustrates a perspective view of the terminal 200 of the second embodiment, and FIG. 14B illustrates a V201 arrow view of FIG. 14A of the terminal 200 illustrated in FIG. 14A. In FIG. 14A and FIG. 14B, the same reference numeral as that of FIG. 1, FIG. 4A, and FIG. 4B is assigned to an equivalent component to a component of the terminal 100 of the first embodiment illustrated in FIG. 1, FIG. 4A, and FIG. 4B. Hereinafter, repeated description of the equivalent component will be omitted.

In the terminal 200 illustrated in FIG. 14A and FIG. 14B, depressed portions 211*c* provided in a pair of respective wall portions 211*b* forming a ceiling wall 211 of a main terminal body portion 210 have shapes as below. The depressed portions 211*c* have a valley shape which reaches a bottom by descending from external surfaces of the pair of respective wall portions 211*b* toward an inside of the main terminal body portion 210, and reaches a pair of respective end edges 211*a* after ascending from the bottom up to a position flush with the external surfaces. That is, in the present embodiment, the pair of end edges 211*a* does not form a portion of the depressed portions 211*c*, and the depressed portions 211*c* are provided at positions separated from the pair of end edges 211*a*. For this reason, in the present embodiment, the pair of end edges 211*a*, the amount of movement of which is largest, is close to each other at the same positions as the external surfaces of the pair of respective wall portions 211*b*.

The terminal 200 of the second embodiment and the connector 1 (FIG. 1) including the terminal 200 may obtain the same effect as that of the terminal 100 of the first embodiment and the connector 1 including the terminal 100. That is, according to the second embodiment, it is possible to obtain a necessary and sufficient contact load for electric connection with the male terminal P of the connector on the other side while avoiding interference between the lance 11*b* and the leaf spring portion 124. In addition, it is possible to obtain sufficient electric connection with the male terminal P of the connector on the other side while suppressing manufacturing cost.

However, in the terminal 100 of the first embodiment and the connector 1 including the terminal 100, the end edge portions 122*a*-1 in the pair of end edges 122*a* form a portion of the depressed portions 122*c*. Further, the end edge portions 122*a*-1 are positioned closer to the inside of the main terminal body portion 120 than from edges 122*c*-1 on the opposite sides in the depressed portions 122*c*. In this way, as described in the foregoing, the first embodiment is advantageous over the second embodiment in that the change of the envelope shape of the main terminal body portion 120 may be suppressed when the male terminal P on the other side is inserted.

Next, a terminal of a third embodiment will be described with reference to FIG. 15. The terminal of the third embodiment is different from the terminal 100 of the first embodiment in shape of a leaf spring portion. Hereinafter, the terminal of the third embodiment will be described, and the description will focus on a difference from the terminal 100 of the first embodiment.

Figure 15:
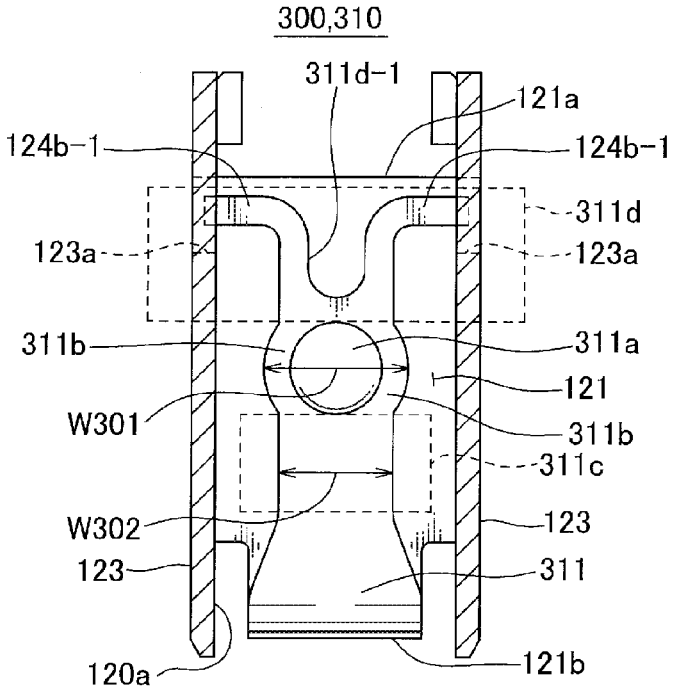
FIG. 15 is a diagram illustrating a shape of a leaf spring portion in a terminal of a third embodiment as a cross-sectional view, which is similar to that of FIG. 7, of a main terminal body portion in the terminal of the third embodiment.

FIG. 15 is a diagram illustrating the shape of the leaf spring portion in the terminal of the third embodiment as a cross-sectional view, which is similar to that of FIG. 7, of a main terminal body portion in the terminal of the third embodiment. In FIG. 15, the same reference numeral as that of FIG. 7 is assigned to an equivalent component to a component of the terminal 100 of the first embodiment illustrated in FIG. 7. Hereinafter, repeated description of the equivalent component will be omitted.

Similarly to the leaf spring portion 124 of the first embodiment, a leaf spring portion 311 included in a main terminal body portion 310 of a terminal 300 of the third embodiment extends in a band shape from an edge portion 121*b* on a bottom wall 121. Further, the leaf spring portion 311 turns back to an inside of the main terminal body portion 310 at an edge portion 121*b*, and extends to the inside of the main terminal body portion 310 in a convex shape which is curved in the middle convexly toward a ceiling wall 122. In the leaf spring portion 311 of the present embodiment, a contact portion 311*a* having a circular shape in plan view is provided in a convex-shaped apex portion, and an outer circumferential portion 311*b* surrounding the contact portion 311*a* at a certain width is provided in the apex portion. For this reason, in the present embodiment, a width W301 of the apex portion including the contact portion 311*a* and the outer circumferential portion 311*b* is wider than a certain width W302 of a portion 311*c* positioned on an opening

120*a* side from the apex portion in a longitudinal direction of the leaf spring portion 311. In the present embodiment, the apex portion including the contact portion 311*a* and the outer circumferential portion 311*b* corresponds to an example of the apex portion mentioned in the invention.

In addition, in the leaf spring portion 311 of the present embodiment, in response to the apex portion formed to have a wide width as described above, another portion has a shape as below. First, the portion 311*c* having the certain width W302 is wider and longer than the portion 124*c* having the certain width W101 in the leaf spring portion 124 of the first embodiment illustrated in FIG. 7. As described above, in the present embodiment, the portion 311*c* having the certain width W302 is long as much as the portion 311*c* is wide. In this way, similarly to the leaf spring portion 124 of the first embodiment, when the leaf spring portion 311 is elastically deformed, the portion 311*c* having the certain width W302 sufficiently warps, and thus concentration of stress on a pair of arm portions 124*b*-1 may be suppressed.

In addition, in the leaf spring portion 311 of the present embodiment, a width of a slit 311*d*-1 provided in an end portion 311*d* which has the pair of arm portions 124*b*-1 is wider than a width of the slit 124*b*-2 in the leaf spring portion 124 of the first embodiment illustrated in FIG. 7. In this way, a split portion in the slit 311*d*-1 reaching up to the pair of arm portions 124*b*-1 may be formed to have similar narrowness to that of the pair of arm portions 124*b*-1, thereby contributing to suppression of a spring constant.

The terminal 300 of the above-described third embodiment and the connector 1 (FIG. 1) including the terminal 300 may obtain the same effect as that of the terminal 100 of the first embodiment and the connector 1 including the terminal 100. That is, according to the third embodiment, it is possible to obtain a necessary and sufficient contact load for electric connection with the male terminal P of the connector on the other side while avoiding interference between the lance 11*b* and the leaf spring portion 311. In addition, it is possible to obtain sufficient electric connection with the male terminal P of the connector on the other side while suppressing manufacturing cost.

In addition, according to the terminal 300 of the third embodiment and the connector 1 including the terminal 300, the width W301 in the apex portion on which stress causing the convex shape to open is prone to be concentrated at the time of elastic deformation is wide in the leaf spring portion 311. As a result, strength with respect to opening of the leaf spring portion 311 is increased. Thus, when the male terminal P on the other side is repeatedly inserted and extracted, it is possible to suppress occurrence of setting of the leaf spring portion 311 such as opening of the convex shape due to plastic deformation.

Next, a terminal of a fourth embodiment will be described with reference to FIG. 16, FIG. 17A, and FIG. 17B. The terminal of the fourth embodiment is different from the terminal 100 of the first embodiment in portion with which a pair of arm portions of a leaf spring portion comes into contact. Hereinafter, the terminal of the fourth embodiment will be described, and the description will focus on a difference from the terminal 100 of the first embodiment.

Figure 16:
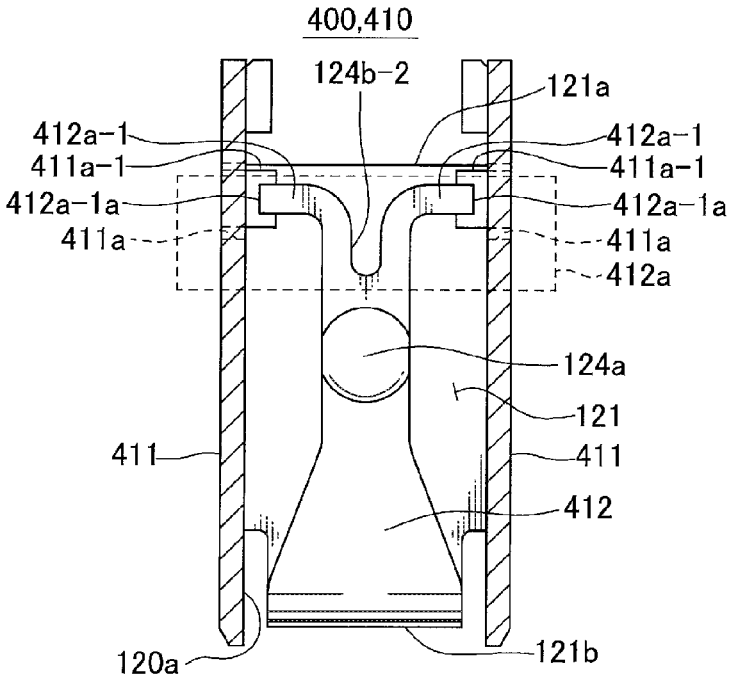
FIG. 16 is a diagram illustrating a portion with which distal ends of a pair of arm portions of a leaf spring portion comes into contact in a terminal of a fourth embodiment as a cross-sectional view, which is similar to that of FIG. 7, of a main terminal body portion in the terminal of the fourth embodiment.
Figure 17A:
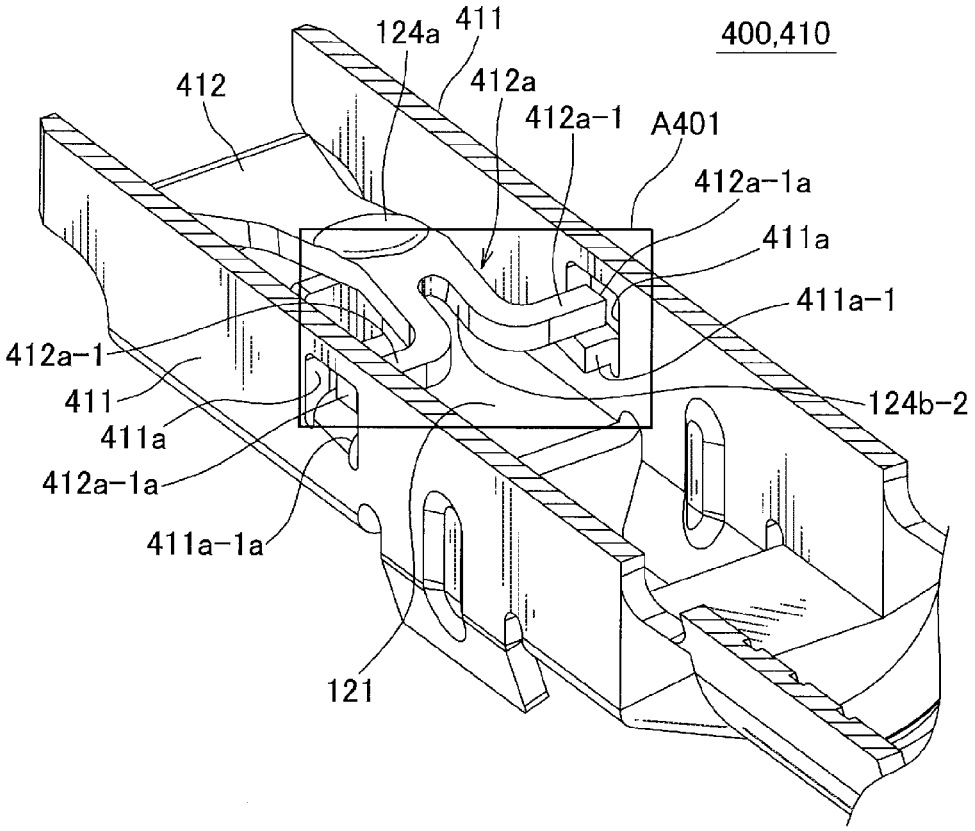
FIG. 17A is a diagram illustrating the portion with which the distal ends of the pair of arm portions of the leaf spring portion comes into contact in the terminal of the fourth embodiment as a perspective view, which is similar to that of FIG. 12A, of the main terminal body portion in the terminal of the fourth embodiment.
Figure 17B:
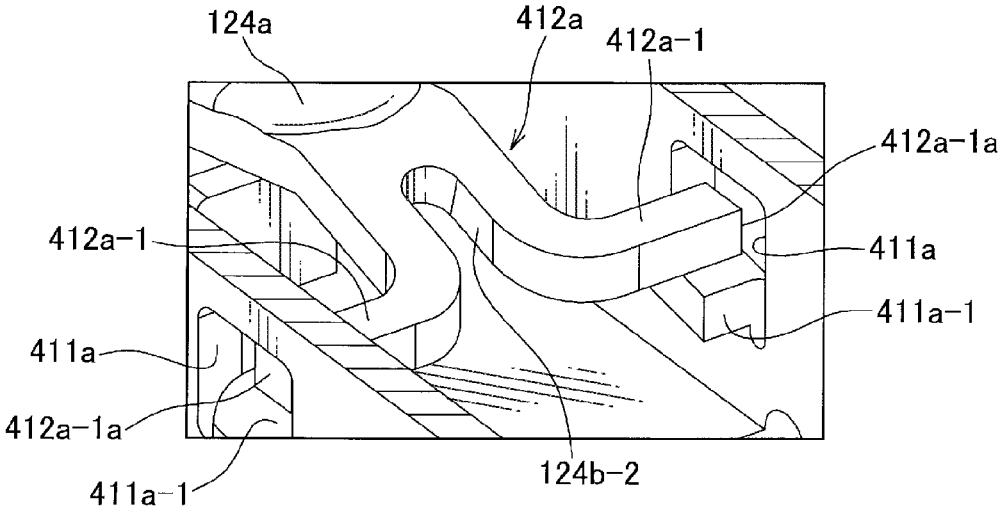
FIG. 17B is a diagram illustrating the portion with which the distal ends of the pair of arm portions of the leaf spring portion comes into contact in the terminal of the fourth embodiment as a perspective view, which is similar to that of FIG. 12B, of the main terminal body portion in the terminal of the fourth embodiment.

FIG. 16 is a diagram illustrating the portion with which the pair of arm portions of the leaf spring portion comes into contact in the terminal of the fourth embodiment as a cross-sectional view, which is similar to that of FIG. 7, of a main terminal body portion in the terminal of the fourth embodiment. In addition, FIG. 17A and FIG. 17B are diagrams illustrating the portion with which the pair of arm portions of the leaf spring portion comes into contact in the terminal of the fourth embodiment as a perspective view, which is similar to that of FIG. 12A and FIG. 12B, of the main terminal body portion in the terminal of the fourth embodiment. FIG. 17A illustrates a perspective view from which an internal configuration of the main terminal body portion 410 in the terminal 400 of the fourth embodiment is viewed, and FIG. 17B illustrates an enlarged view of an area A401 of FIG. 17A. In FIG. 16, FIG. 17A, and FIG. 17B, the same reference numeral as that of FIG. 7, FIG. 12A, and FIG. 12B is assigned to an equivalent component to a component of the terminal 100 of the first embodiment illustrated in FIG. 7, FIG. 12A, and FIG. 12B. Hereinafter, repeated description of the equivalent component will be omitted.

In the main terminal body portion 410 of the terminal 400 of the fourth embodiment, racks 411*a*-1 are cut and raised to protrude toward an inside of the main terminal body portion 410 from inner edge portions on a bottom wall 121 side in through-holes 411*a* provided in a pair of respective lateral walls 411. Distal ends 412*a*-1*a* of a pair of respective arm portions 412*a*-1 provided in an end portion 412*a* of a leaf spring portion 412 come into contact with the pair of respective racks 411*a*-1 protruding from the pair of respective lateral walls 411. In addition, the pair of respective racks 411*a*-1 is linearly inclined toward the bottom wall 121. In addition, the pair of arm portions 412*a*-1 is shorter than the pair of arm portions 124*b*-1 of the first embodiment such that the distal ends 412*a*-1*a* come into contact with the pair of racks 411*a*-1 protruding toward the inside of the main terminal body portion 410.

The terminal 400 of the above-described fourth embodiment and the connector 1 (FIG. 1) including the terminal 400 may obtain the same effect as that of the terminal 100 of the first embodiment and the connector 1 including the terminal 100. That is, according to the fourth embodiment, it is possible to obtain a necessary and sufficient contact load for electric connection with the male terminal P of the connector on the other side while avoiding interference between the lance 11*b* and the leaf spring portion 412. In addition, it is possible to obtain sufficient electric connection with the male terminal P of the connector on the other side while suppressing manufacturing cost.

In addition, according to the terminal 400 of the fourth embodiment and the connector 1 including the terminal 400, when the leaf spring portion 412 is elastically deformed, the pair of racks 411*a*-1 with which the pair of arm portions 412*a*-1 comes into contact warps toward the bottom wall 121. For this reason, for example, it is possible to suppress concentration of excessive stress on a base of the arm. portions 412*a*-1, etc. by allowing the distal ends 412*a*-1*a* of the pair of respective arm portions 412*a*-1 to escape to the bottom wall 121 side when the leaf spring portion 412 is elastically deformed. In this way, when the male terminal P on the other side is repeatedly inserted and extracted, for example, it is possible to suppress occurrence of setting of the leaf spring portion 412 such as plastic deformation of the arm portions 412*a*-1.

Next, a terminal of a fifth embodiment will be described with reference to FIG. 18. The terminal of the fifth embodiment is different from the terminal 100 of the first embodiment in shape of a main terminal body portion. Hereinafter, the terminal of the fifth embodiment will be described, and the description will focus on a difference from the terminal 100 of the first embodiment.

Figure 18:
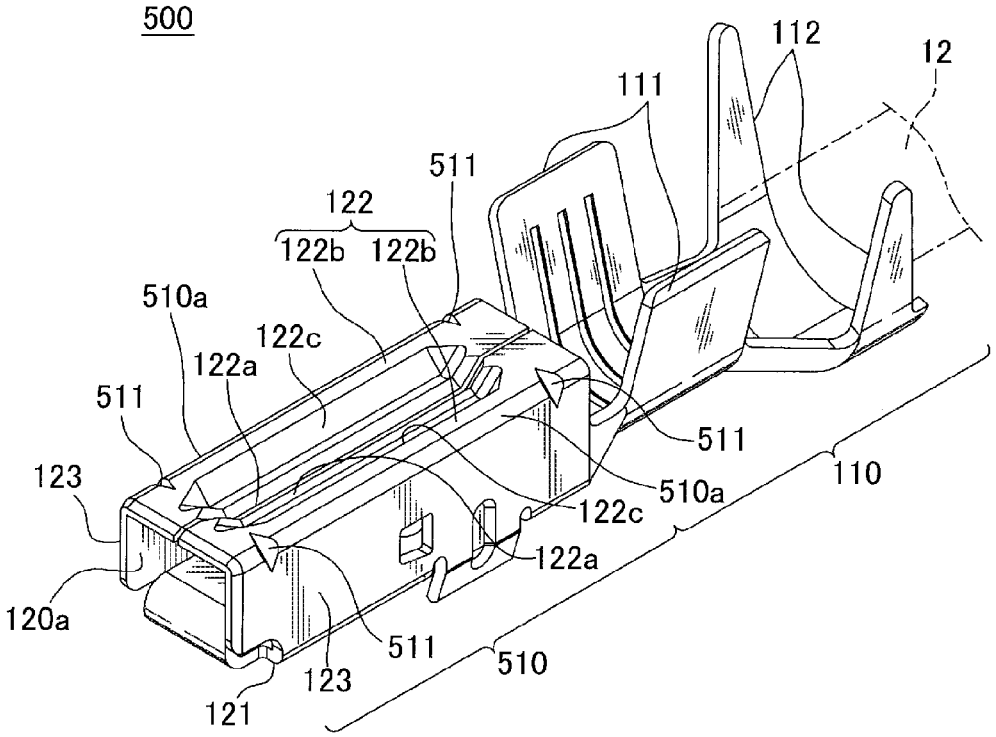
FIG. 18 is a diagram illustrating a terminal of a fifth embodiment as a similar perspective view to that of FIG. 2.
Figure 19:
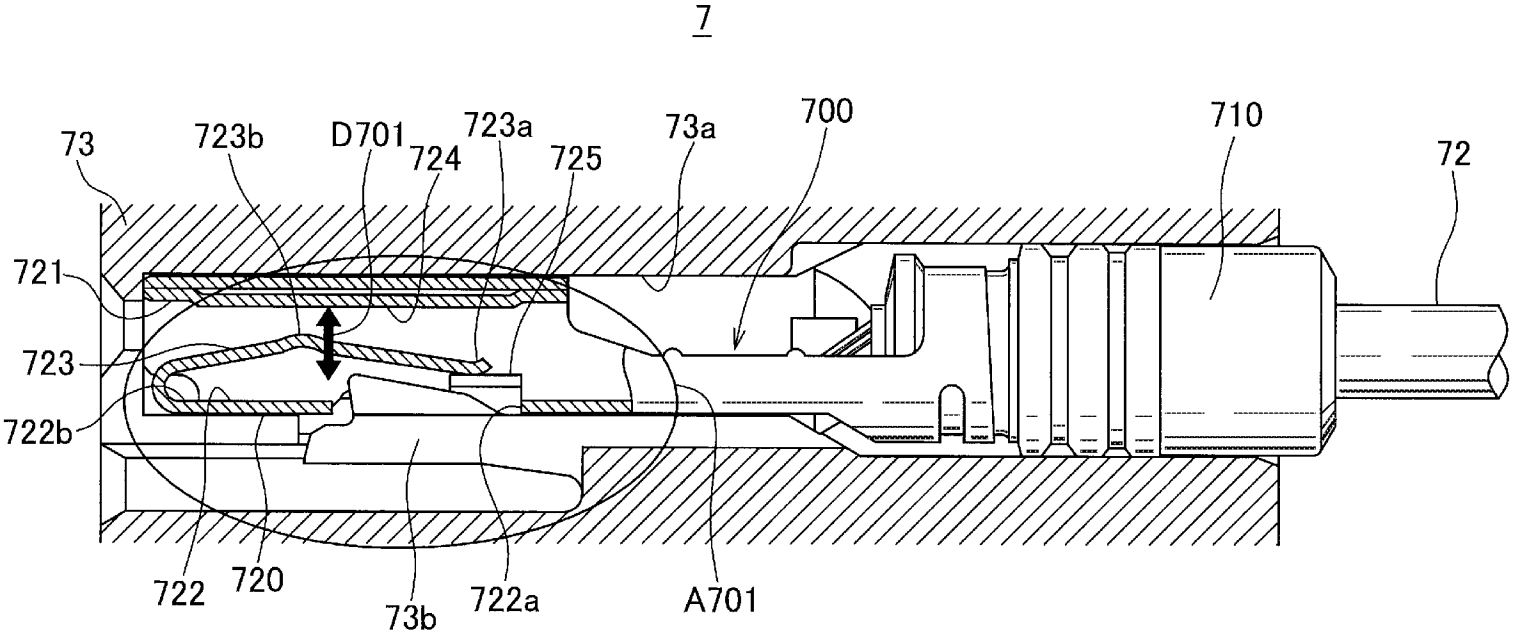
FIG. 19 PRIOR ART
FIG. 19 is a diagram illustrating an example of a conventional terminal provided in a connector.
Figure 20:
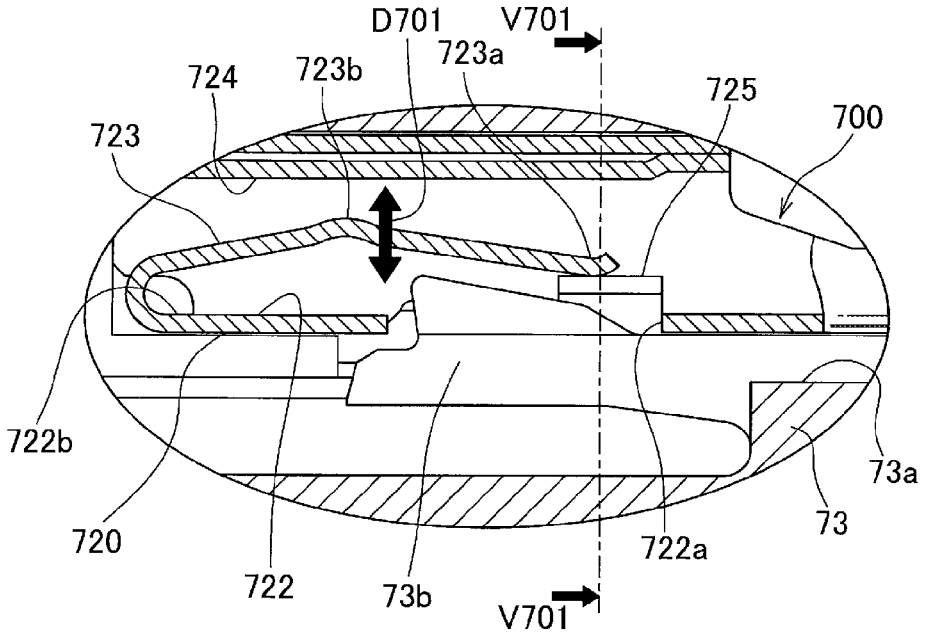
FIG. 20 PRIOR ART
FIG. 20 is an enlarged view of an area A701 of FIG. 19.
Figure 21:
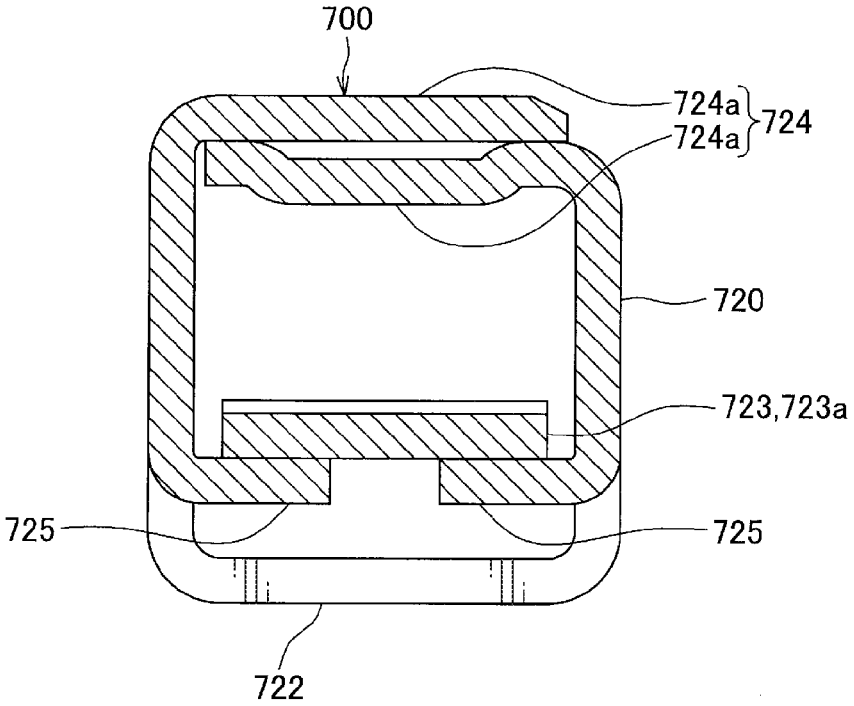
FIG. 21 PRIOR ART
FIG. 21 is a cross-sectional view illustrating a V701-V701 cross section of FIG. 20 of the connector illustrated in FIG. 19.

FIG. 18 is a diagram illustrating the terminal of the fifth embodiment as a similar perspective view to that of FIG. 2. In FIG. 18, the same reference numeral as that of FIG. 2 is assigned to an equivalent component to a component of the terminal 100 of the first embodiment illustrated in FIG. 2. Hereinafter, repeated description of the equivalent component will be omitted.

In a main terminal body portion 510 of a terminal 500 of the fifth embodiment, boundaries between a pair of respective lateral walls 123 that connects a bottom wall 121 to a ceiling wall 122 and a pair of respective wall portions 122*b* forming the ceiling wall 122 correspond to a pair of corner portions 510*a* subjected to chamfering. Further, depressions 511 extending in a direction intersecting the corner portions 510*a* are provided in the pair of respective corner portions 510*a*. In the present embodiment, depressions 511 are provided at an opening 120*a* side and an electric wire fixed portion 110 side in the pair of respective corner portions 510*a*.

The terminal 500 of the above-described fifth embodiment and the connector 1 (FIG. 1) including the terminal 500 may obtain the same effect as that of the terminal 100 of the first embodiment and the connector 1 including the terminal 100. That is, according to the fifth embodiment, it is possible to obtain a necessary and sufficient contact load for electric connection with the male terminal P of the connector on the other side while avoiding interference between the lance 11*b* and the leaf spring portion 124. In addition, it is possible to obtain sufficient electric connection with the male terminal P of the connector on the other side while suppressing manufacturing cost.

In addition, according to the terminal 500 of the fifth embodiment and the connector 1 including the terminal 500, excessive movement is suppressed by the depressions 511 provided in the corner portions 510*a* when the pair of respective wall portions 122*b* forming the ceiling wall 122 moves. In this way, the deformation of the main terminal body portion 510 may be suppressed to a necessary minimum.

The above-described first to fifth embodiments merely correspond to representative modes of the invention, and the invention is not restricted to the embodiments. That is, the embodiments may be variously modified and implemented within a range not departing from the subject matter of the invention.

For example, in the above-described embodiments, the housing 11 including the twelve terminal housing chambers 11*a* is illustrated as an example of the housing mentioned in the invention. However, the housing mentioned in the invention is not restricted thereto, and a specific number of terminal housing chambers, etc. is not an issue when the housing includes the terminal housing chamber.

In addition, in the above-described embodiments, the main terminal body portion 120, 210, 310, 410, or 510 having the shape of the rectangular tube is illustrated as an example of the main terminal body portion mentioned in the invention. However, the main terminal body portion mentioned in the invention is not restricted thereto. For example, a shape of a cylinder, an elliptic cylinder, etc. may be employed when the main terminal body portion is formed in a tubular shape, and a specific shape thereof is not an issue.

In addition, in the present embodiment, the terminal 13, 100, 200, 300, 400, or 500 having one end side corresponding to the tubular-shaped main terminal body portion 120, 210, 310, 410, or 510 and the other end side corresponding to the electric wire fixed portion 110 is illustrated as an example of the terminal mentioned in the invention. However, the terminal mentioned in the invention is not restricted thereto. In the terminal mentioned in the invention, for example, one end side may correspond to the tubular-shaped main terminal body portion, and the other end side may correspond to a pin-shaped portion which is a type of a male terminal. In this terminal, the one end side corresponds to a tubular portion into which the pin-shaped portion is inserted, and the other end side is connected to an electric wire through a relay terminal corresponding to an electric wire fixed portion. In addition, for example, the terminal mentioned in the invention may have both end sides formed in tubular shapes, and may be accommodated in a terminal housing chamber of a housing of a connector. This terminal functions as a relay terminal, and connects a pair of male terminals to each other.

In addition, in the present embodiment, the terminal 13, 100, 200, 300, 400, or 500 having a configuration in which the approach hole 121*a* of the bottom. wall 121 of the main terminal body portion 120, 210, 310, 410, or 510 locks the lance 11*b* is illustrated as an example of the terminal mentioned in the invention. However, the terminal mentioned in the invention is not restricted thereto. For example, the terminal mentioned in the invention may have a configuration in which the lance is locked in an edge portion of the main terminal body portion on the electric wire fixed portion side.

REFERENCE SIGNS LIST

1 connector
11 housing
11*a* terminal housing chamber
11*b* lance
12 electric wire
13, 100, 200, 300, 400, 500 terminal
110 electric wire fixed portion
120, 210, 310, 410, 510 main terminal body portion
120*a* opening
121 bottom wall (example of first side wall portion)
121*a* approach hole
121*b* edge portion
122, 211 ceiling wall (example of second side wall portion)
122*a*, 211*a* pair of end edges
122*a*-1 end edge portions
122*b*, 211*b* pair of wall portions
122*c*, 211*c* depressed portion
122*c*-1 edge on opposite side
123, 411 lateral wall (example of third side wall portion)
123*a*, 411*a* through-hole
123*a*-1 inner edge portion (example of contact portion)
124, 311, 412 leaf spring portion
124*a*, 311*a* contact portion
124*b*, 311*d*, 412*a* end portion
124*b*-1, 412*a*-1 pair of arm portions
124*b*-1*a*, 412*a*-1*a* distal end
124*b*-2, 311*d*-1 slit
124*c*, 311*c* portion
150 metal plate
311*b* outer circumferential portion
411*a*-1 rack
510*a* corner portion
511 depression
D101 lengthwise direction of electric wire
D102 longitudinal direction of main terminal body portion
P male terminal (connector terminal on other side)
W101, W302 certain width
W102, W301 width

What is claimed is:

1. A terminal made of metal capable of being accommodated in a terminal housing chamber provided in a housing of a connector, comprising:

a main terminal body portion extending in a tubular shape into which a mating connector terminal is inserted from an opening at a distal end, including a leaf spring portion formed therein, the leaf spring portion turning back inside the main terminal body portion from an edge portion corresponding to a portion of an edge of the opening, the leaf spring portion, while coming into contact with the mating connector terminal, pressing the inserted mating connector terminal toward a second side wall portion facing a first side wall portion extending from the edge portion in a longitudinal direction of the main terminal body portion, in a side wall of the tubular shape of the main terminal body portion, wherein the main terminal body portion is obtained from a metal plate having a pair of end edges extending in parallel with each other in the longitudinal direction and bent in a tubular shape such that the pair of end edges approaches each other above the leaf spring portion and at the center of the second side wall portion to form the second side wall portion, and each of a pair of wall portions having the pair of end edges forming the second side wall portion is provided with depressed portion bending toward inside of the main terminal body portion and extending in the longitudinal direction.

2. The terminal according to claim 1, wherein end edge portions of at least a portion of the pair of end edges form a portion of the depressed portion, and the end edge portions are positioned closer to inside of the main terminal body portion than edges on opposite sides from the end edge portions in the depressed portion.

3. The terminal according to claim 1, wherein the main terminal body portion is formed in a shape of a rectangular tube in which the first side wall portion and the second side wall portion form a pair of opposing walls, and the corner portion forming boundary between the second side wall portion and each of a pair of third side wall portions connecting the first side wall portion to the second side wall portion is provided with depression extending in a direction intersecting the corner portion.

4. The terminal according to claim 1, wherein first side wall portion is provided with an approach hole formed therein for locking a lance entering the inside of the main terminal body portion from the terminal housing chamber, the leaf spring portion turns back to near the approach hole from the edge portion, and extends in a convex shape toward the second side wall portion to press the mating connector terminal to the second side wall portion while coming into contact with the mating connector terminal at an apex portion, an end portion of the leaf spring portion is positioned closer to the opening than the approach hole, the end portion is provided with a pair of arm portions formed therein branching toward a pair of third side wall portions connecting the first side wall portion to the second side wall portion, a width of the pair of arm portions being narrower than a width before branching, and each of the pair of third side wall portions is provided with contact portion formed therein serving as a fulcrum of the arm portion when the mating connector terminal is inserted and the leaf spring portion is pressed by the mating connector terminal from a side of the second side wall portion.

5. The terminal according to claim 4, wherein a slit extending to the side of the opening of the main terminal body portion is provided between the pair of arm portions in the end portion of the leaf spring portion.

6. The terminal according to claim 4, wherein through-holes are provided at positions to which each of distal ends of the pair of arm portions is headed in the pair of third side wall portions, the contact portions are inner edge portions in inner edges of the through-holes with which the pair of arm portions comes into contact when the leaf spring portion is pushed by the mating connector terminal, and the inner edge portions are linearly inclined in a direction approaching the first side wall portion as separating more from the opening.

7. The terminal according to any one of claims 4, wherein the contact portions are racks protruding from each of the pair of third side wall portions toward inside of the main terminal body portion.

8. The terminal according to any one of claims 4, wherein the leaf spring portion is formed such that a width in the apex portion is wider than a width in a portion on the side of the opening from the apex portion.

9. The terminal according to any one of claims 4, wherein the leaf spring portion includes a portion having near the apex portion between the edge portion and the apex portion a certain width narrower than a width of the edge portion.

10. The terminal according to claim 9, wherein a width gradually decreases from the edge portion to the portion having the certain width.

11. The connector comprising:

the housing in which the terminal housing chamber is provided; and the terminal made of metal including the main terminal body portion extending in a tubular shape into which the mating connector terminal is inserted from the opening at a distal end, the terminal being accommodated in the terminal housing chamber, wherein the terminal is the terminal according to claim 1.

12. The connector comprising:

the housing in which the terminal housing chamber is provided; and the terminal made of metal including the main terminal body portion extending in a tubular shape into which the mating connector terminal is inserted from the opening at a distal end, the terminal being accommodated in the terminal housing chamber, wherein the terminal is the terminal according to claim 2.

13. The connector comprising:

the housing in which the terminal housing chamber is provided; and the terminal made of metal including the main terminal body portion extending in a tubular shape into which the mating connector terminal is inserted from the opening at a distal end, the terminal being accommodated in the terminal housing chamber, wherein the terminal is the terminal according to claim 3.

14. The connector comprising:

the housing in which the terminal housing chamber is provided; and the terminal made of metal including the main terminal body portion extending in a tubular shape into which the mating connector terminal is inserted from the opening at a distal end, the terminal being accommodated in the terminal housing chamber, wherein the terminal is the terminal according to claim 4.

15. The connector comprising:

the housing in which the terminal housing chamber is provided; and the terminal made of metal including the main terminal body portion extending in a tubular shape into which the mating connector terminal is inserted from the opening at a distal end, the terminal being accommodated in the terminal housing chamber, wherein the terminal is the terminal according to claim 5.

16. The connector comprising:

the housing in which the terminal housing chamber is provided; and the terminal made of metal including the main terminal body portion extending in a tubular shape into which the mating connector terminal is inserted from the opening at a distal end, the terminal being accommodated in the terminal housing chamber, wherein the terminal is the terminal according to claim 6.

17. The connector comprising:

the housing in which the terminal housing chamber is provided; and the terminal made of metal including the main terminal body portion extending in a tubular shape into which the mating connector terminal is inserted from the opening at a distal end, the terminal being accommodated in the terminal housing chamber, wherein the terminal is the terminal according to claim 7.

18. The connector comprising:

the housing in which the terminal housing chamber is provided; and the terminal made of metal including the main terminal body portion extending in a tubular shape into which the mating connector terminal is inserted from the opening at a distal end, the terminal being accommodated in the terminal housing chamber, wherein the terminal is the terminal according to claim 8.

19. The connector comprising:

the housing in which the terminal housing chamber is provided; and the terminal made of metal including the main terminal body portion extending in a tubular shape into which the mating connector terminal is inserted from the opening at a distal end, the terminal being accommodated in the terminal housing chamber, wherein the terminal is the terminal according to claim 9.

20. The connector comprising:

the housing in which the terminal housing chamber is provided; and the terminal made of metal including the main terminal body portion extending in a tubular shape into which the mating connector terminal is inserted from the opening at a distal end, the terminal being accommodated in the terminal housing chamber, wherein the terminal is the terminal according to claim 10.

* * * * *